US010264879B2

(12) United States Patent
Game et al.

(10) Patent No.: US 10,264,879 B2
(45) Date of Patent: Apr. 23, 2019

(54) SLAT PANEL ASSEMBLY

(71) Applicant: Evans Consoles Corporation, Calgary, Alberta (CA)

(72) Inventors: Richard Game, Calgary (CA); Matko Papic, Calgary (CA); Carlos Renderos, Calgary (CA); Randy Simington, Calgary (CA)

(73) Assignee: EVANS CONSOLES CORPORATION, Calgary, Alberta (CA)

( * ) Notice: Subject to any disclaimer, the term of this patent is extended or adjusted under 35 U.S.C. 154(b) by 0 days.

(21) Appl. No.: 15/686,857

(22) Filed: Aug. 25, 2017

(65) Prior Publication Data

US 2018/0055229 A1 Mar. 1, 2018

Related U.S. Application Data

(60) Provisional application No. 62/380,018, filed on Aug. 26, 2016.

(51) Int. Cl.

| | |
|---|---|
| ***A47B 83/00*** | (2006.01) |
| ***A47B 21/02*** | (2006.01) |
| ***A47B 46/00*** | (2006.01) |
| ***A47B 21/03*** | (2006.01) |
| ***A47B 21/04*** | (2006.01) |

(Continued)

(52) U.S. Cl.

CPC ..... *A47B 83/001* (2013.01); *A47B 21/02* (2013.01); *A47B 21/03* (2013.01); *A47B 21/04* (2013.01); *A47B 46/005* (2013.01); *A47B 87/002* (2013.01); *A47B 96/205* (2013.01); *A47B 2200/0078* (2013.01)

(58) Field of Classification Search

CPC ..... A47B 96/205; A47B 21/03; A47B 21/04
USPC ..... 248/228.1, 219.4, 214, 222.52
See application file for complete search history.

(56) References Cited

U.S. PATENT DOCUMENTS

| | | | | |
|---|---|---|---|---|
| 4,527,760 A * | 7/1985 | Salacuse | ..... | A47K 1/09 24/DIG. 53 |
| 4,677,794 A * | 7/1987 | Parron | ..... | A47B 57/565 248/222.14 |
| 4,852,839 A * | 8/1989 | Winter | ..... | A47B 57/485 211/192 |

(Continued)

FOREIGN PATENT DOCUMENTS

| | | |
|---|---|---|
| GB | 2 326 089 A | 12/1998 |
| WO | 97/19617 A2 | 6/1997 |

OTHER PUBLICATIONS

European Search Report for European Application No. 17188002.4.

*Primary Examiner* — Joshua K Ihezie
(74) *Attorney, Agent, or Firm* — Notaro, Michalos & Zaccaria P.C.

(57) ABSTRACT

Slat walls and slat rails are used for mounting various equipment such as displays. According to an aspect, there is provided an equipment mounting assembly comprising at least one slat pane, at least one upright support member, and for each upright support member, a respective connector for mounting the upright support member to a structure. Each slat panel includes a respective plurality of horizontal slats on a front face thereof. Each slat panel is mounted to the at least one upright support member at a rear face thereof. Two or more slat panels may be stacked. The connector may include a collar portion that engages an upper panel of a console or other structure.

19 Claims, 36 Drawing Sheets

(51) Int. Cl.
*A47B 96/20* (2006.01)
*A47B 87/00* (2006.01)

(56) References Cited

U.S. PATENT DOCUMENTS 5,103,741 A * 4/1992 Grund ..... A47B 17/033 108/101
5,199,836 A * 4/1993 Gogarty ..... F16B 37/045 411/104
5,794,901 A * 8/1998 Sigel ..... B23Q 3/102 248/207
5,797,572 A * 8/1998 Schmucki ..... E03D 11/143 248/222.52
5,988,076 A 11/1999 Vander Park
6,923,407 B2 * 8/2005 Takeuchi ..... F16B 21/02 24/458
7,290,690 B2 * 11/2007 Hancock ..... B63B 25/002 114/343
7,621,487 B2 * 11/2009 Brown ..... F16L 3/24 248/65
8,465,242 B2 * 6/2013 Arendt ..... F16B 7/187 411/551
9,161,622 B1 * 10/2015 Dressendorfer ..... A47B 83/001
2003/0001058 A1 * 1/2003 Oddsen, Jr. ..... F16M 11/2014 248/314
2004/0035067 A1 * 2/2004 Vander Park ..... A47B 21/06 52/242
2008/0010935 A1 1/2008 Nagel
2010/0288168 A1 * 11/2010 Rheault ..... A47B 13/10 108/28
2014/0124468 A1 * 5/2014 Lundrigan ..... A47B 87/0284 211/182
2014/0197289 A1 * 7/2014 Chen ..... F16M 13/022 248/214
2015/0096472 A1 * 4/2015 Papic ..... A47B 9/20 108/28
2015/0311854 A1 * 10/2015 Goehringer ..... F24J 2/5203 211/41.1

* cited by examiner

SLAT PANEL ASSEMBLY

RELATED APPLICATION

This application claims priority to U.S. Provisional Patent Application Ser. No. 62/380,018, filed on Aug. 26, 2016, the entire content of which is incorporated herein by reference.

FIELD OF THE DISCLOSURE

This disclosure relates to equipment mounting systems for consoles. More particularly, the disclosure relates to slat wall and slat rail assemblies and the like.

BACKGROUND

Consoles are used in a variety of different applications, including in control rooms, on trading floors, and in operations centers. Consoles are typically used in the place of generic office equipment. Consoles may provide an enhanced human machine interface by allowing for the positioning of equipment in the more useful and efficient positions. Furthermore, consoles may be adapted to support more equipment compared to generic office equipment.

Consoles may include a slat panel assembly, such as a slat wall or slat rail. Slat walls and slat rails are used for mounting various equipment such as displays. Such slat panel assemblies may also be used on other structures, such as shelfs, walls, counters, etc. Displays, shelves, and other equipment may be mounted to a slat wall, typically using a mounting bracket that securely engages one or more slats of the slat wall. Conventional slat panel systems may not be easily customizable. For example, slat walls may come in pre-set heights and may not be easy to modify. Convention slat panel systems may also be designed for particular connectors/mounts for a particular type of console, and may not be easily customized to fit on a variety of consoles.

SUMMARY

According to one aspect, there is provided an equipment mounting assembly comprising: at least one slat panel, each said at least one slat panel having a respective front face and a respective rear face, and comprising a respective plurality of horizontal slats on the front face; at least one upright support member, each said at least one slat panel being mounted to the at least one upright support member at the rear face of the slat panel; for each upright support member, a respective connector for mounting the upright support member to a structure.

In some embodiments, each said connector comprises: a respective collar portion having a periphery and comprising a collar that defines a channel extends at least partially about the periphery, the collar portion defining a generally vertical passage therein to receive the upright support member, the upright support member being securable to the connector and extending upward from the collar portion when received in the passage.

In some embodiments, for each said connector, the collar of the collar of the collar portion comprises: a respective wall having an upper, outwardly extending lip; and a respective plate below the wall that extends outwardly beyond the wall, the plate, the upper lip and the wall thereby forming a channel.

In some embodiments, the collar portion definiens a second generally vertical passage therethrough.

In some embodiments, the plate of the collar portion defines one or more holes for receiving fastening hardware to secure the plate to a bottom face of a work surface panel.

In some embodiments, the connector further comprises at least one plate extending downward from the collar portion for engaging a frame member of the structure.

In some embodiments, at least one of said at least one plate further engages and is secured to the upright support.

In some embodiments, the connector further comprises at least one plate extending upward from the collar portion that engages and is secured to the upright support.

In some embodiments, the upright support comprises a post.

In some embodiments, the upright support defines at least one elongate port along a length of the upright support, the port being configured for receiving fastening hardware.

In some embodiments, the equipment mounting assembly further comprises a one or more attachment strips, each said attachment strip received in a respective one of the at least port and comprising one or more holes and, for each hole, a self-clinching nut aligned with the hole.

In some embodiments, each at least one slat panel comprises a respective slat wall panel.

In some embodiments, the at least one slat wall panel comprises two or more slat wall panels.

In some embodiments, the two or more slat wall panels are stacked vertically.

In some embodiments, the slats of the at least one slat panel are equally spaced.

In some embodiments, each slat panel defines one or more elongate ports along a length of the slat panel, the one or more ports being configured for receiving fastening hardware.

In some embodiments, the equipment mounting assembly further comprises a housing enclosure, the at least one slat panel positioned at a front of the housing enclosure.

In some embodiments, the housing enclosure comprises a front cover, the front cover comprising at least one opening.

In some embodiments, the at least one slat panel comprises a single slat panel in the form of a slat rail.

In some embodiments, the slat rail has a top and a bottom, the slat rail defining an elongated upper port in the top thereof for receiving a mounting strip for a vertically aligned panel.

In some embodiments, the equipment mounting assembly further comprises the panel, the panel being mounted to the connecting strip on the slat rail.

According to another aspect, there is provided a connector for a slat panel assembly comprising: an upright support; a bracket assembly, the upright support being mounted to the bracket assembly, and the bracket assembly comprising: a collar portion having a periphery and defining a channel that extends at least partially about the periphery, the collar portion defining a generally vertical passage therethrough to receive the post, the post being securable to the bracket assembly when received in the hole and extending upward from the collar portion.

In some embodiments, the collar portion comprises: a wall extending at least partially around a periphery of the collar portion, and having an upper, outwardly extending lip; and a plate below the wall that extends outwardly beyond the wall and is generally parallel to the upper lip, wherein the plate, the upper lip and the wall thereby form the channel.

In some embodiments, the collar portion comprises: a wall extending at least partially around a periphery of the collar portion, and having an upper, outwardly extending lip; and a plate below the wall that extends outwardly beyond the wall and is generally parallel to the upper lip, wherein the plate, the upper lip and the wall thereby form the channel.

According to another aspect, there is provided an equipment mounting assembly comprising: two or more slat wall panels, each said at least one slat panel having a respective front face and a respective rear face, and comprising a respective plurality of horizontal slats on the front face; and at least one upright support member mountable to a structure, the two or more slat wall panels being mounted, in a stacked configuration, to the at least one upright support member at the rear faces of the slat panels.

In some embodiments, the slats of the two or more slat wall panels are equally spaced.

Other aspects and features of the present disclosure will become apparent, to those ordinarily skilled in the art, upon review of the following description of the specific embodiments.

BRIEF DESCRIPTION OF THE DRAWINGS

Aspects and embodiments of the disclosure will now be described in greater detail with reference to the accompanying diagrams, in which.

DETAILED DESCRIPTION

Equipment mounting assemblies including one or more slat panels, such as slat walls or slat rails, may be used for mounting equipment on a console or other structure (e.g. shelves, walls, etc.). The term "slat panel" as used herein refers to any panel having a front face with a plurality of spaced apart slats thereon for mounting equipment thereto. For example, displays, shelves or other equipment may be mounted by brackets that extend between and securely engage the slats. Various embodiments of equipment mounting assemblies, including slat wall assemblies and slat rail assemblies, will now be described. Some embodiments may also combine one or more slat walls and/or slat rails.

It is to be understood that the slat panel assemblies described herein are not limited to use with consoles, and may be mounted to other structures, such as shelving units, walls, counters, etc.

Figure 1:
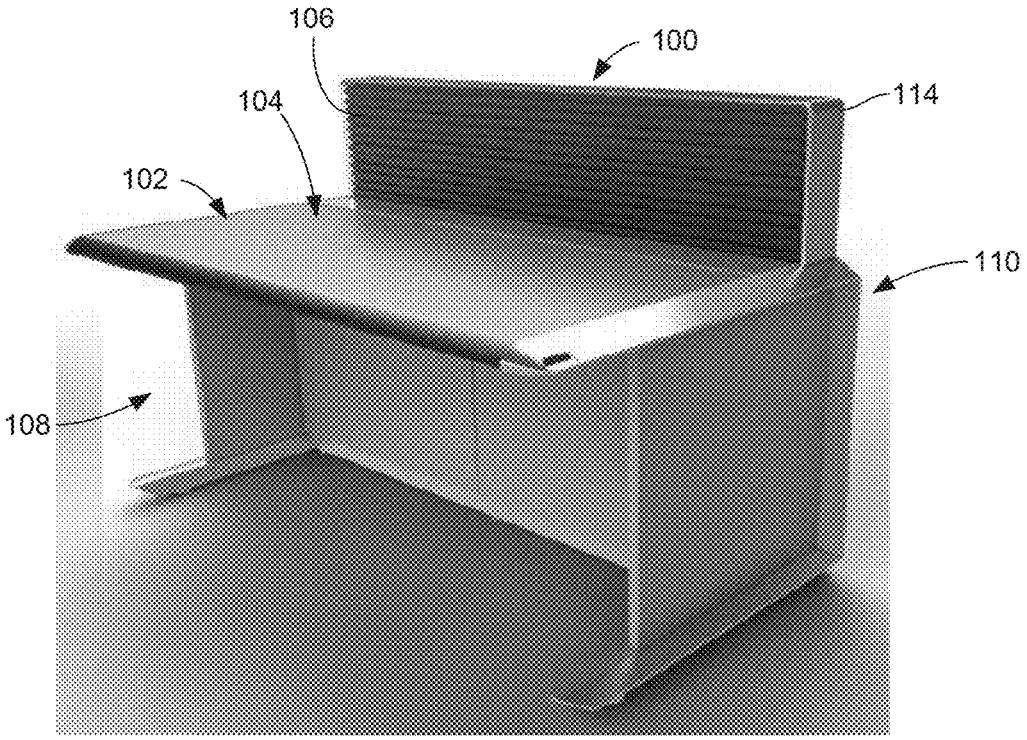
FIG. 1 is a front perspective view of a slat wall assembly, according to some embodiments, mounted on a console.

FIG. 1 is a front perspective view of a slat wall assembly 100, according to some embodiments, mounted on an example console 102. As shown, the slat wall assembly 100 in this example is positioned on a top 104 of the console 102. The slat wall assembly includes a slat panel 106 that faces forward. Various equipment (such as displays) may be mounted to the slat wall panel 106. For example, one or more mounting brackets may engage the slats of the slat wall panel. The slat wall assembly 100 includes an optional housing 114 shown in FIG. 1.

A front 108 and rear 110 of the console 102 are indicated in FIG. 1. These terms and similar terminology herein does not limit the console 102 or slat wall assembly 100 to use in a particular orientation. Rather, such terminology is used for ease of description. For example, a user may stand or sit in front of the console 102 and slat wall assembly 100. However, embodiments are not limited to this arrangement. Similarly, the terms "horizontal" and "vertical" do not imply absolutely horizontal or plumb, but are instead used generally. For example, a "vertical" element is not necessarily perfectly vertical, but may be angled and/or may be curved or bent, but still extending in a generally vertical direction.

Figure 2:
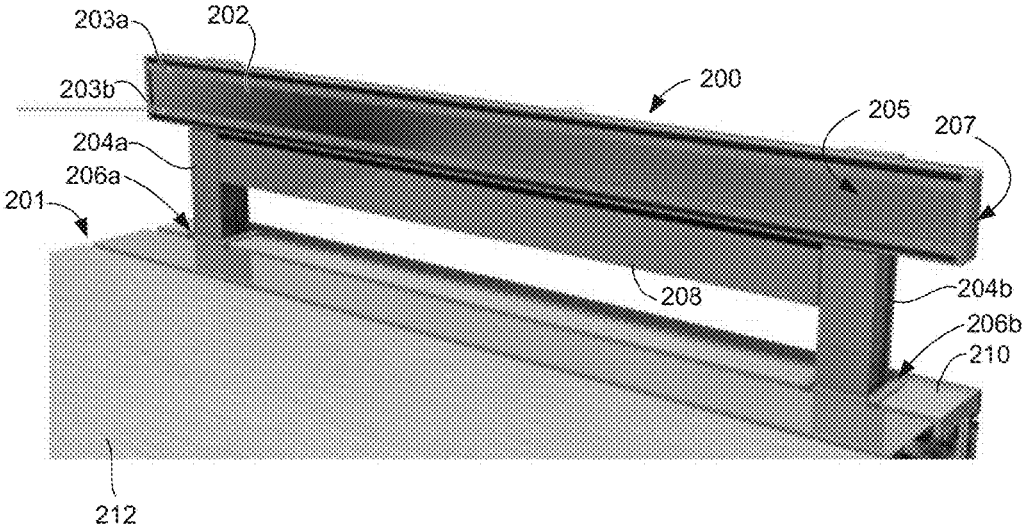
FIG. 2 is a front perspective view of a slat rail assembly according to some embodiments mounted on another example console.

FIG. 2 is a front perspective view of a slat rail assembly 200 according to some embodiments mounted on another example console 201 (which is only partially shown). The slat rail assembly 200 includes an elongate slat rail 202 having an upper slat 203*a* and a lower slat 203*b* on its front face 205. The slat assembly 200 also includes a first upright support member 204*a* and a second upright support member 204*b* spaced apart from the first support member 204*a*. More or fewer support members may be used in other embodiments. The slat rail 202 is mounted to the first and second upright support members 204*a* and 204*b* at the rear face 207 of the slat rail 202. The slat rail assembly 200 also includes a first connector 206*a* and a second connector 206*b*. The first and second connectors 206*a* and 206*b* connect the first and second upright support members 204*a* and 204*b*, respectively, to the console 201. More specifically, the first and second connectors 206*a* and 206*b* are secured to an upper panel 210 of the console, and may also be secured to a frame (not shown) of the console. The example upper panel 210 of the console 201 is approximately level with a work surface panel 212, although that is not required. In some embodiments, the connectors 206*a* and 206*b* may attach to the work surface panel itself. The first and second upright support members 204*a* and 204*b* are fixed to the first and second connectors 206*a* and 206*b* respectively.

The slat rail assembly 200 also includes optional cable management enclosure 208 under the slat rail, which may assist with cable management, as will be discussed in more detail below.

The slat wall assembly 100 in FIG. 1 includes upright support members and connectors similar to those in FIG. 2, although they are not visible in FIG. 1.

Figure 3:
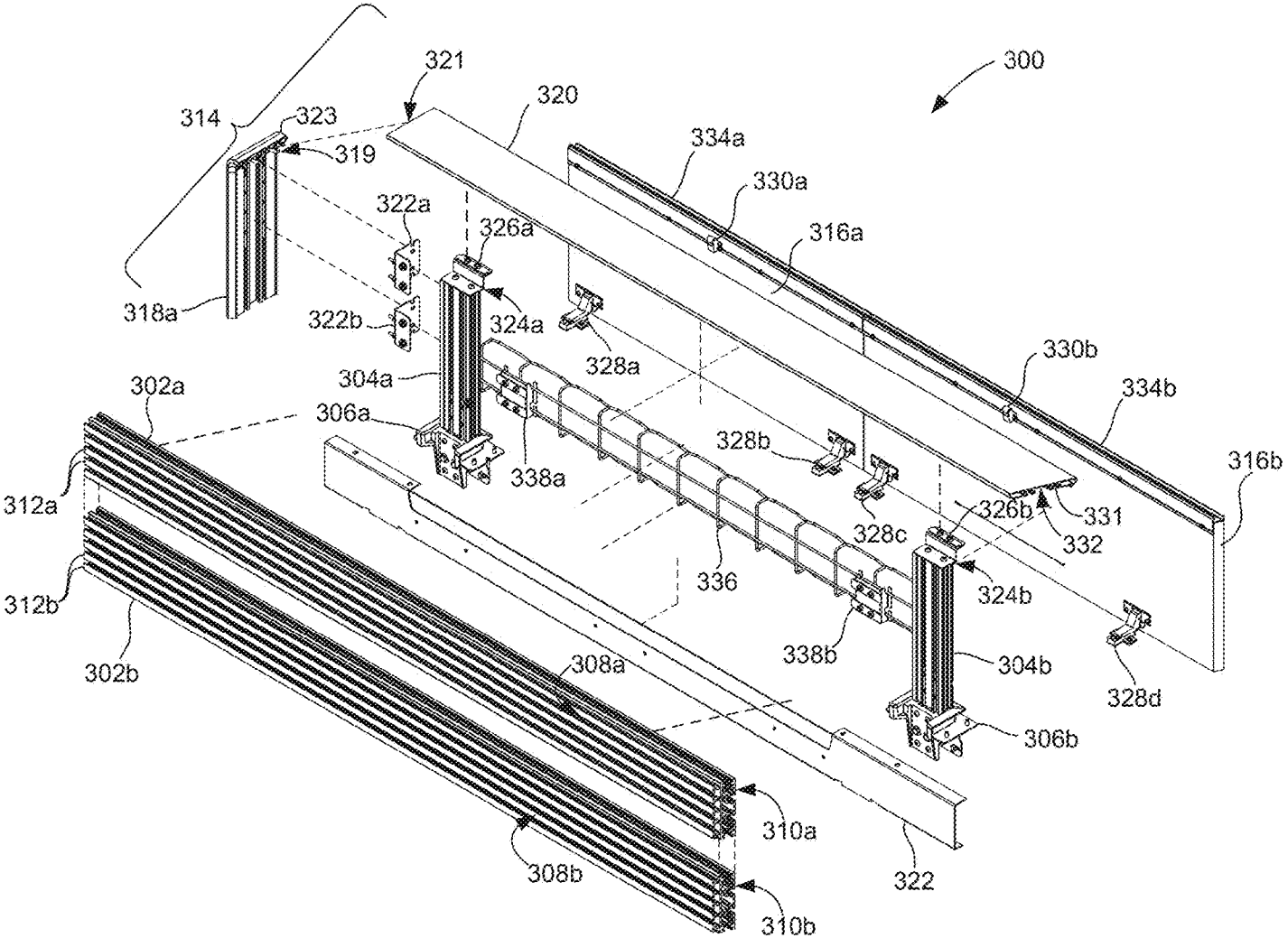
FIG. 3 is an exploded front perspective view of a slat wall assembly according to some embodiments.

FIG. 3 is an exploded front perspective view of a slat wall assembly 300 according to some embodiments. The slat wall assembly 300 comprises first and second elongate slat wall panels 302*a* and 302*b*, which both have the same structure in this embodiment (although slat wall panels having the same structure is optional). The slat wall assembly 300 also includes first and second upright support members 304*a* and 304*b* and, for each support 304*a* and 304*b*, a respective connector 306*a* and 306*b* for connecting the slat wall assembly to a console or other structure (e.g. shelves, walls, counter).

The first slat wall panel 302*a* has a front face 308*a* and a rear face 310*a*, and includes a plurality of horizontal, spaced apart slats 312*a* on the front face 308*a*. The second slat wall panel 302*b* has the same structure with front face 308*b* and rear face 310*b*, and a plurality of horizontal, spaced apart slats 312*b* on the front face 308*b*. The particular size and shape of the slats 312*a* and 312*b*, and the recessed spaces between them may vary. Embodiments are not limited to any particular configuration of the slats on the slat wall panels 302*a* and 302*b*. The slats 312*a* and 312*b* in this example are ridges with a T-shaped cross-sectional profile, although other slat configurations for mounting equipment thereto may be used.

Each slat wall panel 302*a* and 302*b* is securely attached, at its rear face 310*a* or 310*b*, to the first and second upright support members 304*a* and 304*b*. The first and second connectors 306*a* and 306*b* attach to the first and second upright support members 304*a* and 304*b* respectively and are mountable to a console (such as the console 100 or 200 in FIGS. 1 and 2).

The slat wall assembly 300 in this example includes an optional housing 314 that includes rear panels 316*a* and 316*b*, a first side cover 318*a*, a second side cover 318*b* (not shown in FIG. 3, but shown in FIG. 7) opposite to the first side cover 318*a*, a top cover 320 and a front cover 322 in this example. The side covers 318*a* and 318*b* and the top cover 320 are in the form of a strip extrusion (e.g. plastic extrusion) in this example. A corner casting 323*a* attaches the upper end 319 of the first side cover 318*a* to the corresponding end 321 of the top cover 320. The second side cover 318*b* is similarly attached to the opposite end of the top cover 320. The first side cover 318*a* attaches to the first upright support member 304*a* by brackets 322*a* and 322*b* and fastening hardware (e.g. screws). The top cover 320 attaches to top ends 324*a* and 324*b* of the first and second upright support members 304*a* and 304*b* via brackets 326*a* and 326*b* and fastening hardware (e.g. screws).

The rear panels 316*a* and 316*b* may attach to an upper surface of the console (not shown) by hinges 328*a* to 328*d*. The rear panels 316*a* and 316*b* include upward extending snap clips 330*a* and 330*b* that releasably engage an elongated port 331 in an underside 332 of the top cover 320. The rear panels 316*a* and 316*b* also include upper gripping strips 334*a* and 334*b*. It will be appreciated that the housing may have a variety of different configurations, and embodiments are not limited to the particular structural details and arrangement of the example housing 314 shown in FIG. 3.

Figure 4:
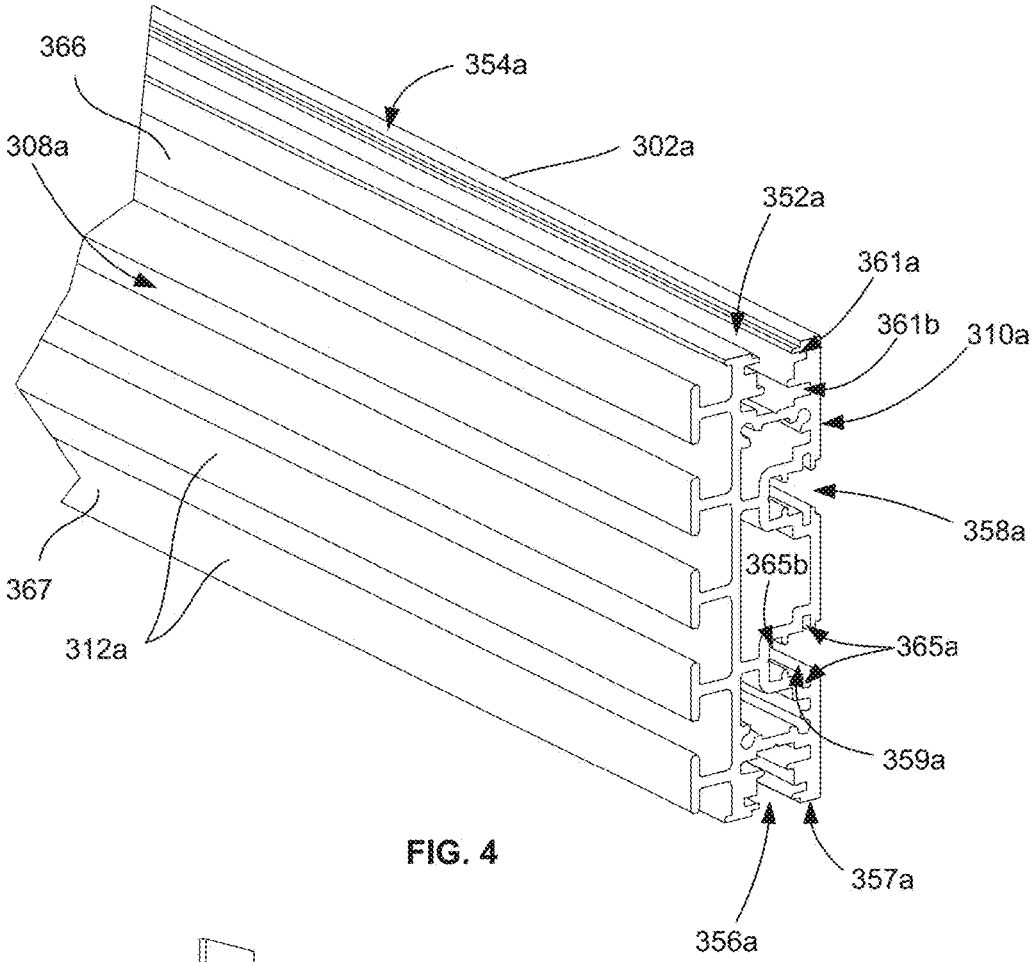
FIG. 4 is an enlarged partial front perspective view of a slat wall panel of the slat wall assembly of FIG. 3.

An optional wire tray 336 for cable management is mounted within the housing 314 in this embodiment. The tray 336 is attached to the first and second upright support members 304*a* and 304*b* by brackets 338*a* and 338*b* respectively. Other cable management features or other equipment (e.g. power outlets or network ports) may also be included within the housing 314 of the slat wall assembly 300. FIG. 4 is an enlarged partial front perspective view of the first slat wall panel 302*a*. As mentioned above, the second slat wall panel 302*b* (FIG. 3) has the same structure. The slat wall panels 302*a* and 302*b* in this example are metal extrusions (e.g. aluminum extrusions), although embodiments are not limited to extrusions or to metal. The profile of the slat wall panel 302*a* is more clearly visible in FIG. 4. The spaced apart slats 312*a* are shown on the front face 308*a*. As also shown, the slat wall panel 302 also includes a plurality of elongated slot-type ports along its length. More specifically, a top port 352*a* is defined and extend along the top 354*a* of the slat wall panel 302*a*; a bottom port 356*a* is defined and extend along the bottom 357*a* of the slat wall panel 302*a*; and two spaced apart rear ports 358*a* and 359*a* are defined and extend along the rear face 310*a*.

Figure 5:
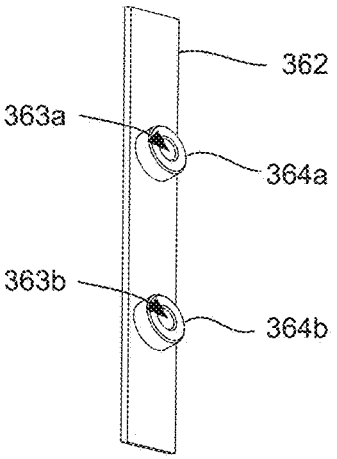
FIG. 5 is a front view of an example attachment strip according to an embodiment.

These ports 352*a*, 356*a*, 358*a* and 359*a* are shaped to receive various fastening hardware. For example, nuts or bolt heads may be received in the ports 352*a*, 356*a*, 358*a* or 359*a*. As a more specific example, the rear ports 358*a* and 359*a* each receive two attachment strips 362 (of the type shown in FIG. 5) for securing the first slat wall panel 302*a* to the first and second upright support members 304*a* and 304*b* shown in FIG. 3. The attachment strip 362 in FIG. 5 is sized to be received in a widened slot 365*a* portion of the rear ports 358*a* and 359*a*. The attachment strip 362 defines two holes 363*a* and 363*b*. A self-clinching nut 364*a* or 364*b* is provided at each hole 363*a* and 363*b*. The nuts 364*a* and 364*b* may be adhered to or integral with the strip 362. Thus, bolts extending through the into the holes 363*a* and 363*b* will engage the self-clinching nuts 364*a* or 364*b*.

The various ports shown in the drawings and described herein may be configured or modified to perform various functions. For example, the top port 352*a* includes a first widened slop 361*a* and a second widened slot 361*b*, which is positioned farther inward from the top 354*a* of the slat wall panel 302*a*. The bottom port 356*a* mirrors the top port 352*a*. The first widened slot 361*a* may receive an attachment strip, for example. The second widened slot 361*b* in this example is sized to optionally receive an LED strip to provide edge lighting. The rear ports 358*a* and 358*b* also each define second widened slots 365*b* that may similarly receive an LED strip, for example. Thus, the ports 352*a*, 356*a*, 358*a* and 358*b* are not limited to receiving fastening hardware.

Similar attachment strips and other fastening hardware (e.g. bolts) may be received in ports of other extrusions described and shown herein for the purpose of securing various elements together. The elongated ports and attachment strips shown and described herein may facilitate customizing the configuration of the slat wall and slat rail assemblies described herein because the strips may be placed at various positions along the length at the ports. Furthermore, the length of the strips and the number of holes/nuts may be configured as desired. However, it is to be understood that embodiments are not limited to such attachment strips and ports as means for connecting the various elements of the assemblies described herein. Any suitable method to secure various assembly elements together may be used.

With reference again to FIG. 4, the slats 312*a* are equally spaced apart (although other embodiments may use non-uniform spacing). The slats 312*a* include a top slat 366 and a bottom slat 367. The second slat panel 302*b* (FIG. 3) has the same structure, as mentioned above. The top slat 366 and bottom slat 367 of the panels 302*a* and 302*b* are positioned such that, when stacked, the space between the adjacent bottom slat 367 of the first panel 302*a* and the top slat 366 of the second panel 302*b* is the same as the space between any other adjacent pair of slats. For example, if each pair of adjacent slats 312*a* in FIG. 4 are a distance "d" apart, then the top slat may be a distance ½ d from the top 354*a* of the panel 302*a* and the bottom slat 367 may likewise be a distance ½ d from the bottom 357*a* of the panel 302*a*. Other arrangements to provide a similar result may also be used. By maintaining an equal spacing between slats, including adjacent slats of stacked slat wall panels, a mounting bracket that engages two spaced apart slats may span across the intersection between two of the stacked slat wall panels.

Figure 6:
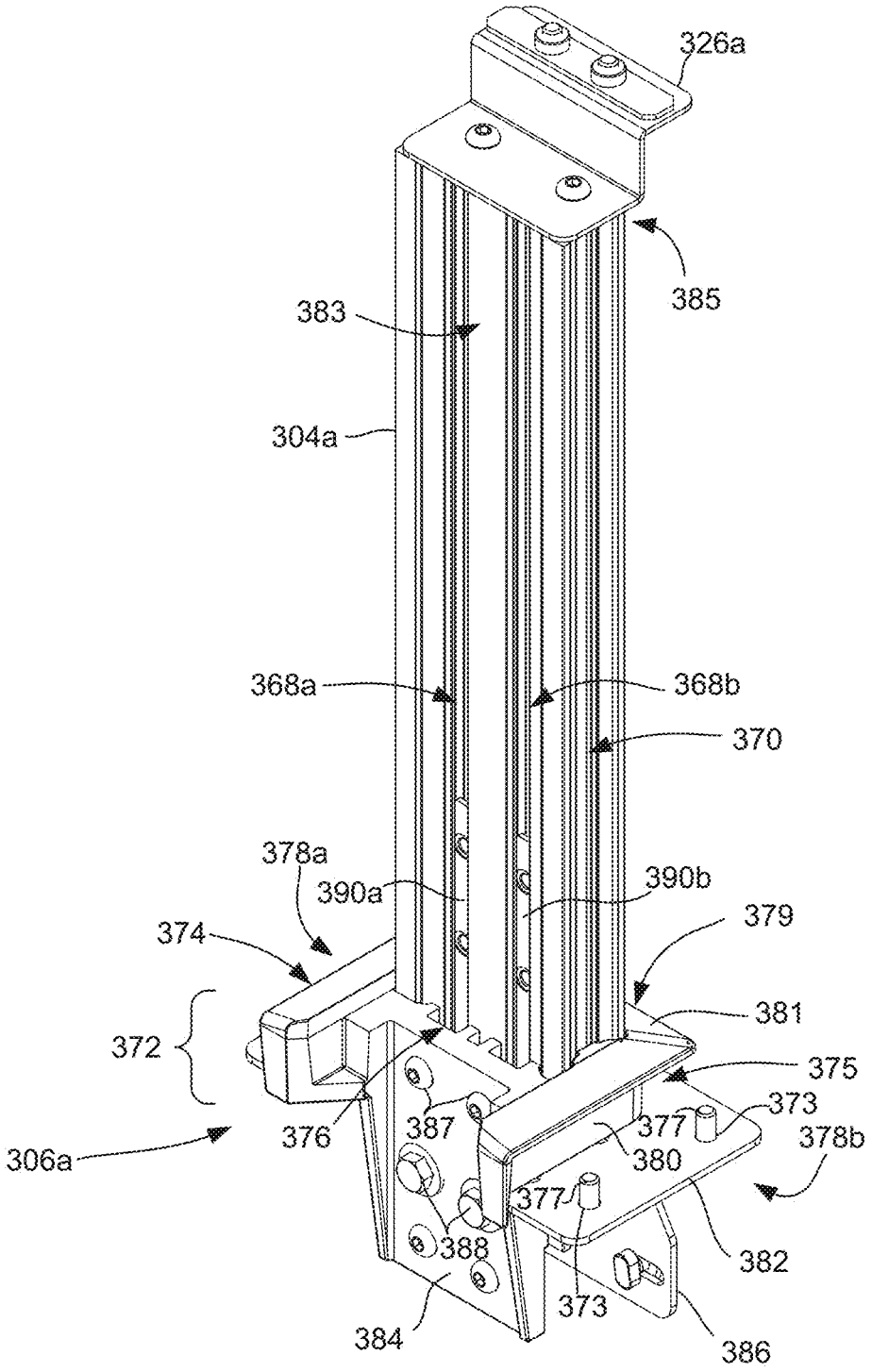
FIG. 6 is a front perspective view of an upright support member, a connector and a bracket from FIG. 3.

FIG. 6 is a front perspective view of the first upright support member 304*a*, the first connector 306*a* and the bracket 326*a* from FIG. 3. The second upright support member 304*b* and the second connector 306*b* (shown in FIG. 3) have the same structure as the first upright support member 304*a* and the first connector 306*a*. Embodiments are not limited to the example connectors 306*a* and 306*b*, and other types of connections and connecting hardware may be used to mount the slat wall and slat rail assemblies described herein.

The upright support member 304*a* is in the form of a post or beam in this embodiment. The example upright support member 304*a* is an extrusion (e.g. aluminum), but embodiments are not limited to extrusions or to any particular material. The upright support member 304*a* defines two spaced apart, front facing elongated ports 368*a* and 368*b* as well as a first side port 370 and an opposite second side port (not visible in FIG. 6). The ports 368*a* and 368*b* and 370 are for receiving fastening hardware, such as attachment strips 390*a* and 390*b*. Other strips (such as strips 890*a*, 890*b*, 891*a* or 891*b* in FIG. 21) may also be used in ports 368*a*,368*b* or 370.

The connector 306*a* in this embodiment includes a collar portion 372 that comprises a collar 374 and a lower plate 382. The collar 374 extends at least partially about the periphery of the collar portion 372. As shown in FIG. 6, the collar 374 in this example extends around sides 378*a* and 378*b* and rear 379 of the collar portion 372. The collar portion 372 defines a generally vertical passage 376 therethrough to receive the upright support member 304*a*. In some embodiments, the passage 376 may not extend completely through the collar portion 372. The upright support member 304*a* is securable to the connector (when received in the passage 376) and extends upward from the collar portion 372 as shown. As will be explained in more detail below, the collar portion 372 may engage an upper panel (e.g. work surface panel) of a console or other structure.

The collar 374 of the collar portion 372 comprises a wall 380 with an upper, outwardly extending lip 381. The lip 381 is in the form of a horizontally extending flange in this example. The lower plate 382 is positioned adjacent to and below the wall 380 and extends horizontally and outwardly beyond the wall 380. The lower plate 382 is generally parallel to the upper lip 381 in this example. The wall 380, thus extends between the upper lip 381 and the plate 382 in this example. The plate 382, the upper lip 381 and the wall 380 therebetween define a channel 375.

Figure 17:
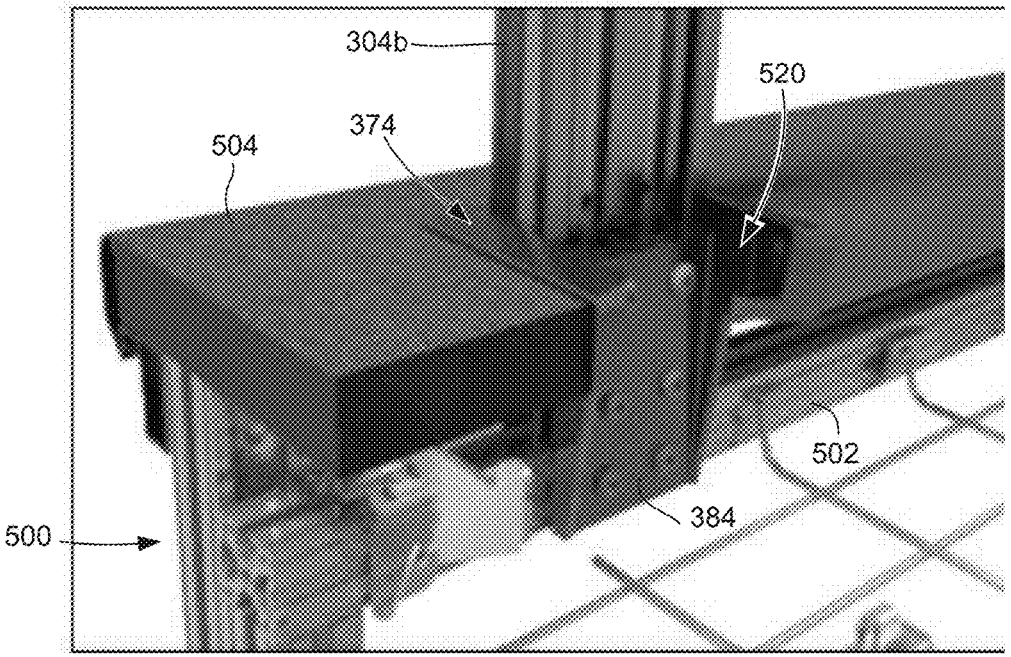
FIG. 17 is an enlarged front partial perspective view of a connector and upright support member of FIGS. 15 and 16 shown mounted to a console frame and upper panel.

The channel 375 may receive and hold an edge portion of an upper or top panel (such as a work surface panel) of a console. The plate 382 defines holes 373 for receiving screws 377 or other fastening hardware to attach the plate 382 to the underside of such a panel. See, for example, FIG. 17 showing the collar portion 374 secured to an upper panel 504 of an example console.

The connector 306*a* in FIG. 6 further includes a front plate 384 and a back plate 386. The front and back plates 384 and 386 extend downward below the collar portion 372 in this example. The front plate 384 is secured to a front face 383 of the upright support member 304*a*, and the back plate 386 is secured to the rear face 385 of the upright support member 304*a*. More specifically, attachment strips 390*a* and 390*b* are received in the front facing ports 368*a* and 368*b* respectively. The attachment strips 390*a* and 390*b* include holes/self-clinching nuts (not shown) that align with and engage bolts 387 extending through the front plate 384. Additional bolts 388 extend through the front plate 384, the upright support member 304*a* and the back plate 386, where they are secured by nuts 389 (see in FIG. 16).

As shown, the collar 374 extends a distance forward from the front plate 384.

The front and rear plates 384 and 386 may engage and be secured to a console frame (see FIGS. 13 to 16, for example). In other embodiments, one of the front and lower plates 384 and 386 may be omitted.

The connector 306*a* may be formed in any suitable manner. In this example, the front and back plates 384 and 386 and the wall 380 and upper lip 381 of the collar 374 are a unitary structure formed by a moulding process. The plate 382 is then attached by screws or other means (e.g. welding, adhesive, etc.). However, in other embodiments, the entire connector 306 may be a unitary body, or alternatively the front and back plates 384 and 386 and the wall 380 and upper lip 381 may be an assembly of separately formed parts. The various parts may be connected in any suitable manner. The connector 306*a* may be metal or any other suitable material for supporting the weight of the slat wall assembly 300 (FIG. 3) and equipment that may be mounted thereto.

The connector 306*a* is shown by way of example, and embodiments are not limited to the particular structure of the connector 306*a*. Similarly, embodiments are not limited to the particular upright support member 304*a* shown. For example, in other embodiments, a slat wall (comprising one or more slat wall panels) may be mounted to a post or pillar without elongated ports. The connector may be a simple plate or bracket (e.g. L-shaped bracket) that connects the post to a panel or frame of a console.

Figure 7:
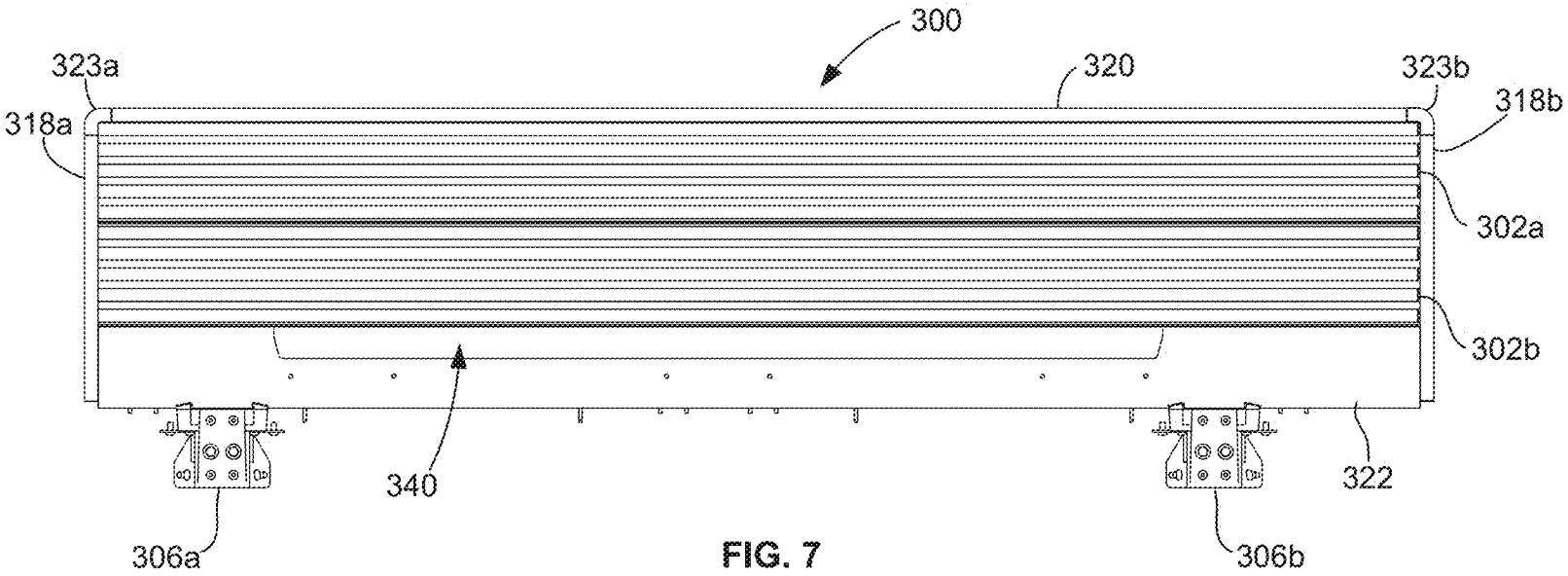
FIG. 7 is a front view of the slat wall assembly of FIG. 3, as assembled

FIG. 7 is a front view of the slat wall assembly 300 of FIG. 3, as assembled. As shown, the first slat wall panel 302*a* and stacked on top of the second slat wall panel 302*b*. Other embodiments may include three or more stacked slat wall panels. Thus, the height of the slat wall assembly and number of slats may be customized by selecting the number of slat wall panels.

The front cover 322 sits under the second slat wall panel, although the position of the front cover 322 may vary. For example, the front cover may sit between the first and second slat wall panels 302*a* and 302*b*. Alternatively, the front cover 322 may be omitted and/or replaced by a third slat wall panel. Various configurations are possible.

The front cover 322 includes an opening 340 through which cables of various equipment (e.g. displays) may pass. The opening 340 may be a brush grommet, for example. Additional openings may also be included in other embodiments.

FIG. 7 also shows the first and second side covers 318*a* and 318*b* and top cover 320, which are connected by corner castings 323*a* and 323*b*. In other embodiments, the side and top covers may be a unitary element (e.g. a single extrusion strip). First and second connectors 306*a* and 306*b* are also shown.

The slat wall assembly 300 may further include power outlets or network communication ports in various positions of the housing 314 (e.g. in the front cover 322) to provide power and/or data access to equipment mounted on the assembly.

Figure 8:
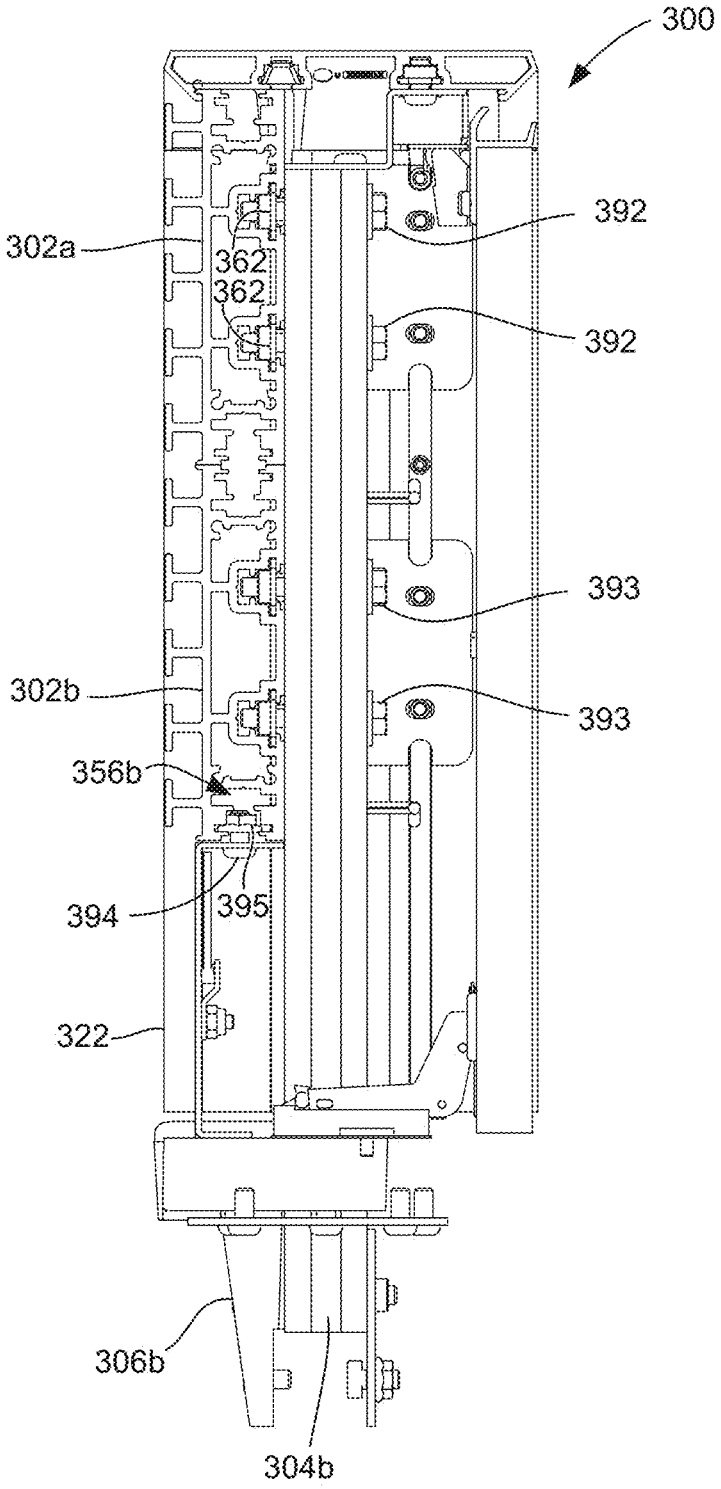
FIG. 8 is a right-side view of the slat wall assembly with a side cover removed

FIG. 8 is a right-side view of the slat wall assembly 300, with the second side cover 318*b* (FIG. 7) removed so that the first and second slat wall panels 302*a* and 302*b* and the second upright support member 304*b* are visible. Bolts 392 extend through the second upright support member 304*b* and attach to corresponding attachment strips 362 to secure the first slat wall panel 302*a*. The second slat wall panel 302*b* is similarly secured by bolts 393. Another bolt 394 attaches to nut 395 in bottom port 356*b* of the second slat wall panel 302*b* to secure the front cover 322 to the second slat wall panel 302*b*.

Figure 9:
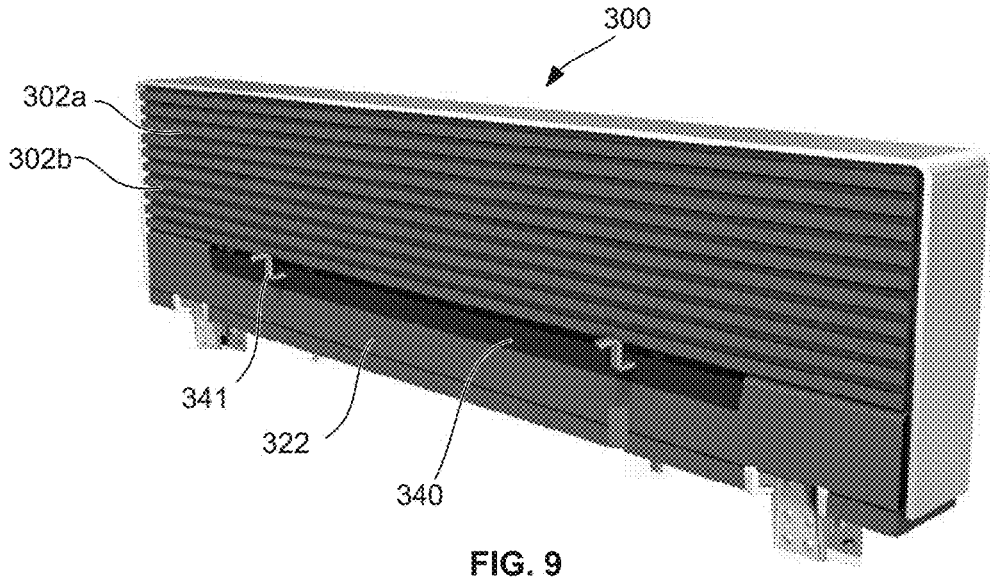
FIG. 9 is a front perspective view of the slat wall assembly of FIGS. 3 and 7.

FIG. 9 is a front perspective view of the slat wall assembly 300, including the brush grommet 340 in the front cover 322. Example cables 341 are partially shown extending through the brush grommet 340.

Figure 10:
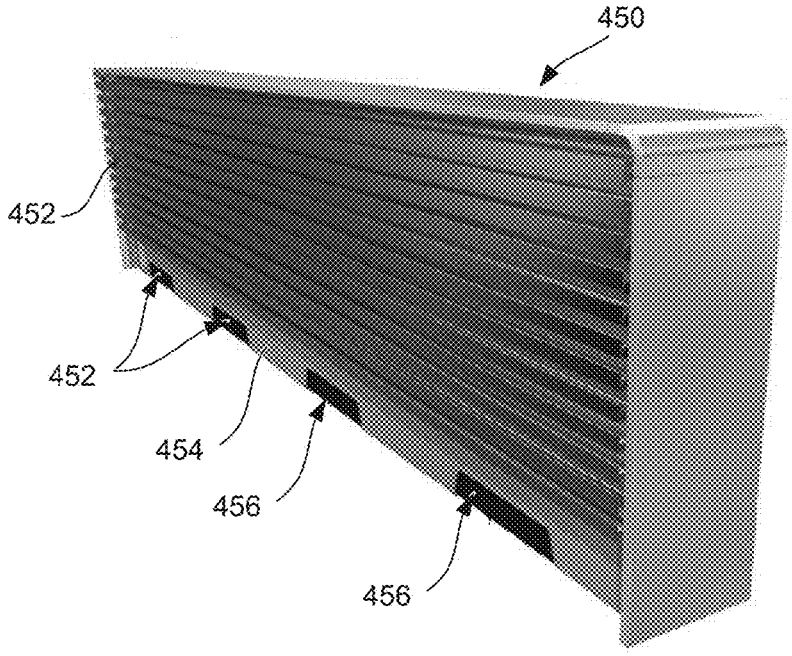
FIG. 10 is a front perspective view of a slat wall assembly according to another embodiment.

FIG. 10 is a front perspective view of a slat wall assembly 450 according to another embodiment. The slat wall assembly 450 is taller (including more slats) than the slat wall assembly 300 of FIGS. 3, 7 and 8, and has a shorter front cover 454. The front cover 454 includes openings 456. Otherwise, the slat wall assembly 450 of FIG. 9 is similar to the slat wall assembly 300 of FIGS. 3, 7 and 8.

Figure 11:
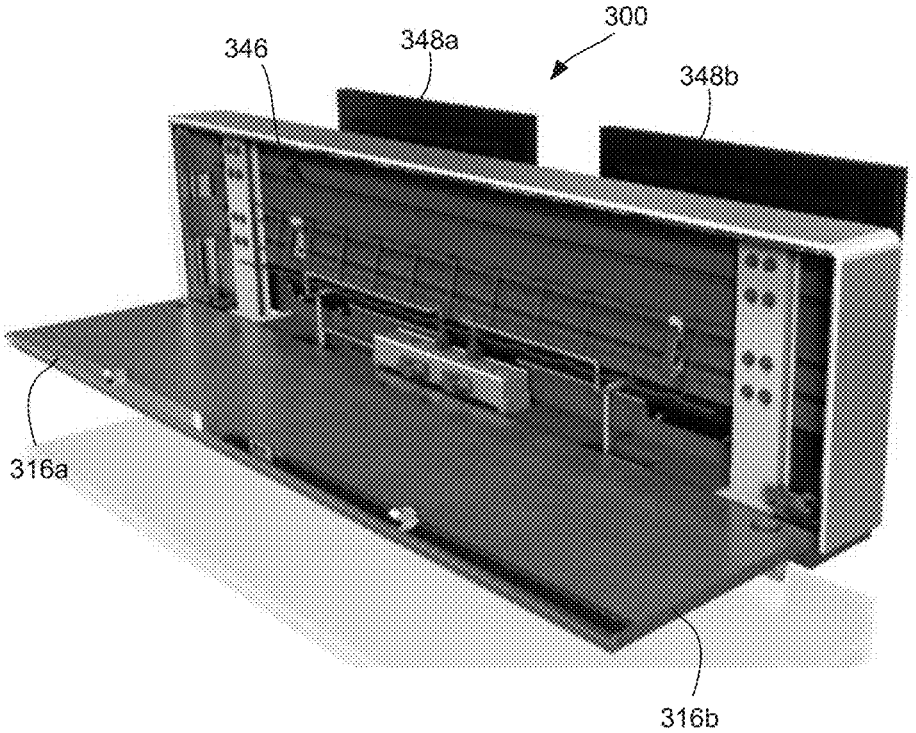
FIG. 11 is a is a rear perspective view of the slat wall assembly of FIGS. 3, 7 and 8.

FIG. 11 is a is a rear perspective view of the slat wall assembly 300 of FIGS. 3, 7 and 8, showing the rear panels 316*a* and 316*b* in an opened position, providing access to the interior 346 of the slat wall assembly. Example displays 348*a* and 348*b* and shown mounted to the slat wall assembly 300.

Figure 12:
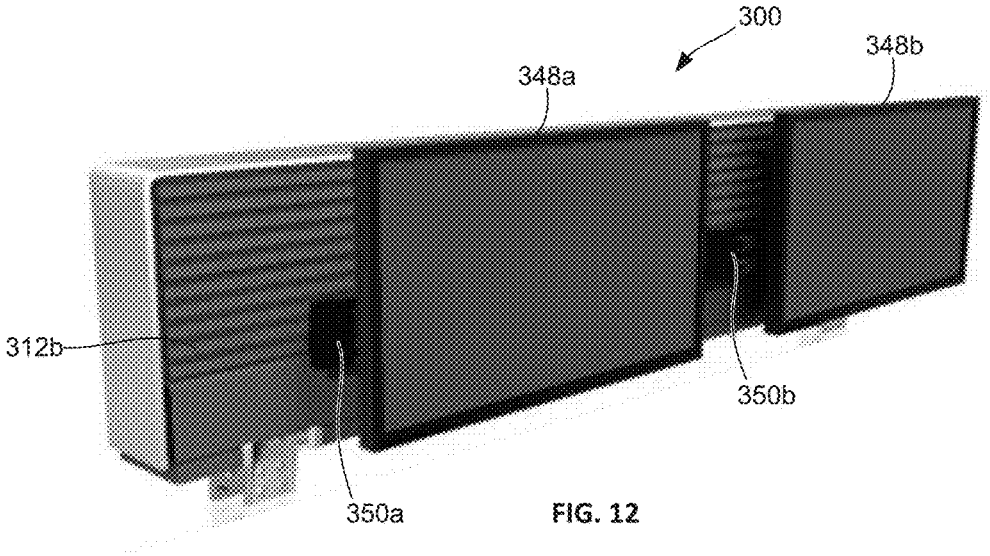
FIG. 12 is a front perspective view of the slat wall assembly of FIG. 9.

FIG. 12 is another front perspective view of the slat wall assembly 300 of FIG. 9, showing the displays 348*a* and 348*b* mounted by brackets 350*a* and 350*b* respectively. The brackets 350*a* and 350*b* engage the slats 312*b* of the second slat panel 302*b* in this example. Of course, the position (lateral or vertical) of one or both brackets 350*a* and 350*b* may be adjusted.

Figure 13:
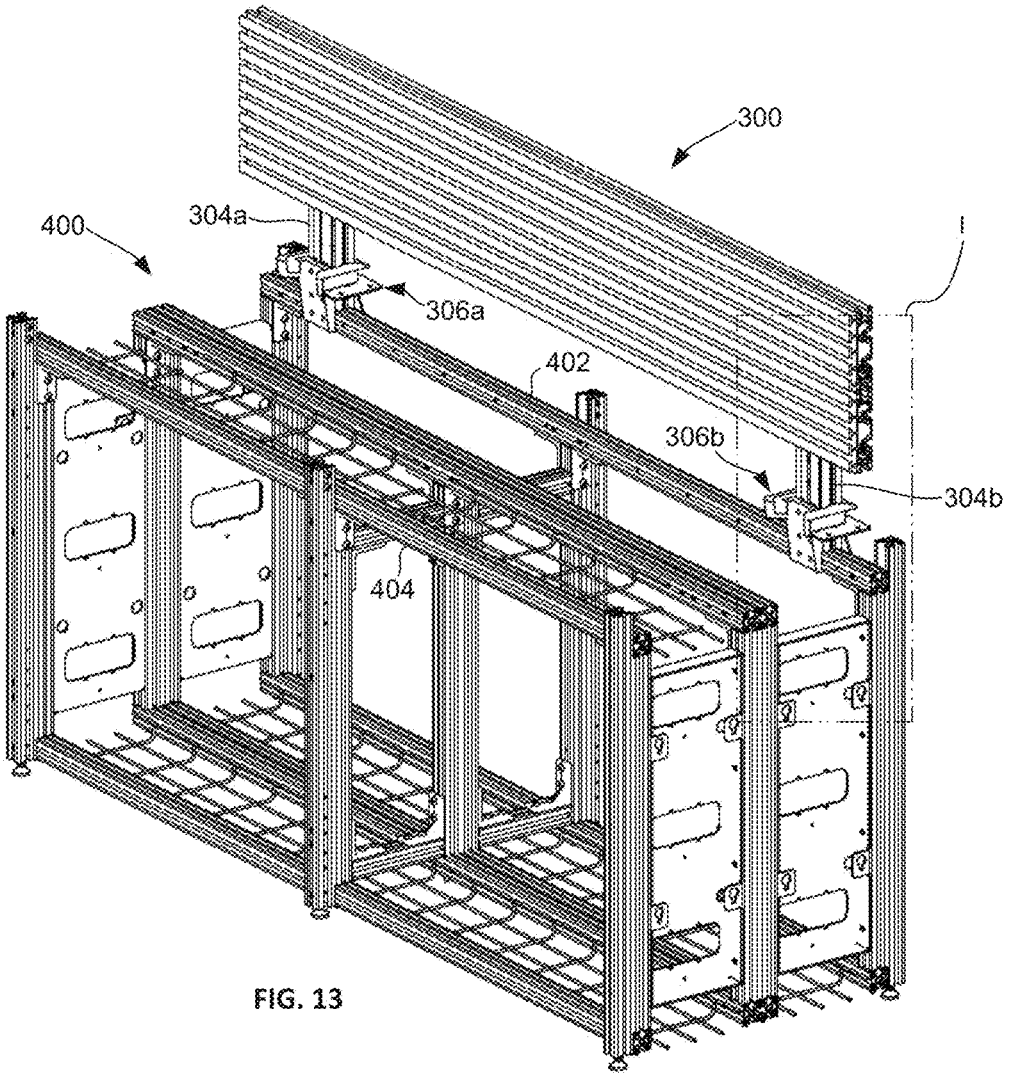
FIGS. 13 and 14 are front and rear perspective views, respectively, of the slat wall assembly of FIGS. 3, 7 and 8 mounted on an example console frame module.
Figure 14:
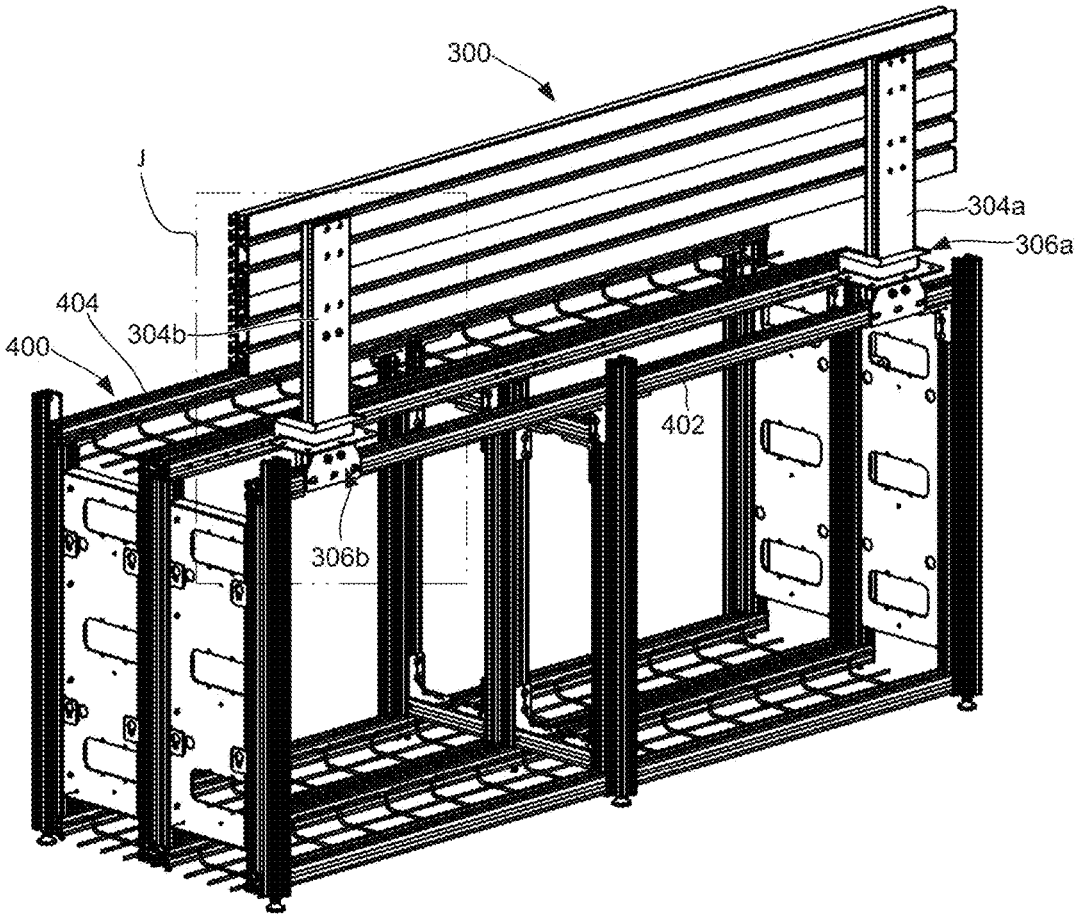

FIGS. 13 and 14 are front and rear perspective views, respectively, of the slat wall assembly 300 of FIG. 3 mounted on an example console frame module 400. The housing 314 (FIGS. 3, 7 and 8) of the assembly 300 has been removed so that the first and second upright support members 304*a* and 304*b* and the first and second connectors 306*a* and 306*b* are visible. As mentioned above, the housing 314 may be omitted in some embodiments.

One or more panels (e.g. work surface, front, side or rear panels), feet, support arms (not shown) etc. may be attached to the frame module 400 to form a console. See, for example, the example console 1950 shown in FIGS. 43 and 44.

Turning again to FIGS. 13 and 14, the slat wall assembly 300 is shown attached to an upper beam 402 of the frame module. The slat wall assembly 300 may also be mounted to a different beam (e.g. beam 404 shown in FIGS. 13 and 14) of the frame module 400. Furthermore, the example frame module 400 in FIG. 13 is provided only by way of example, and the slat wall assembly 300 is not limited to use with this particular frame module 400. However, the slat wall assembly 300 may be attached to other different of frames, consoles, or other furniture.

Figure 15:
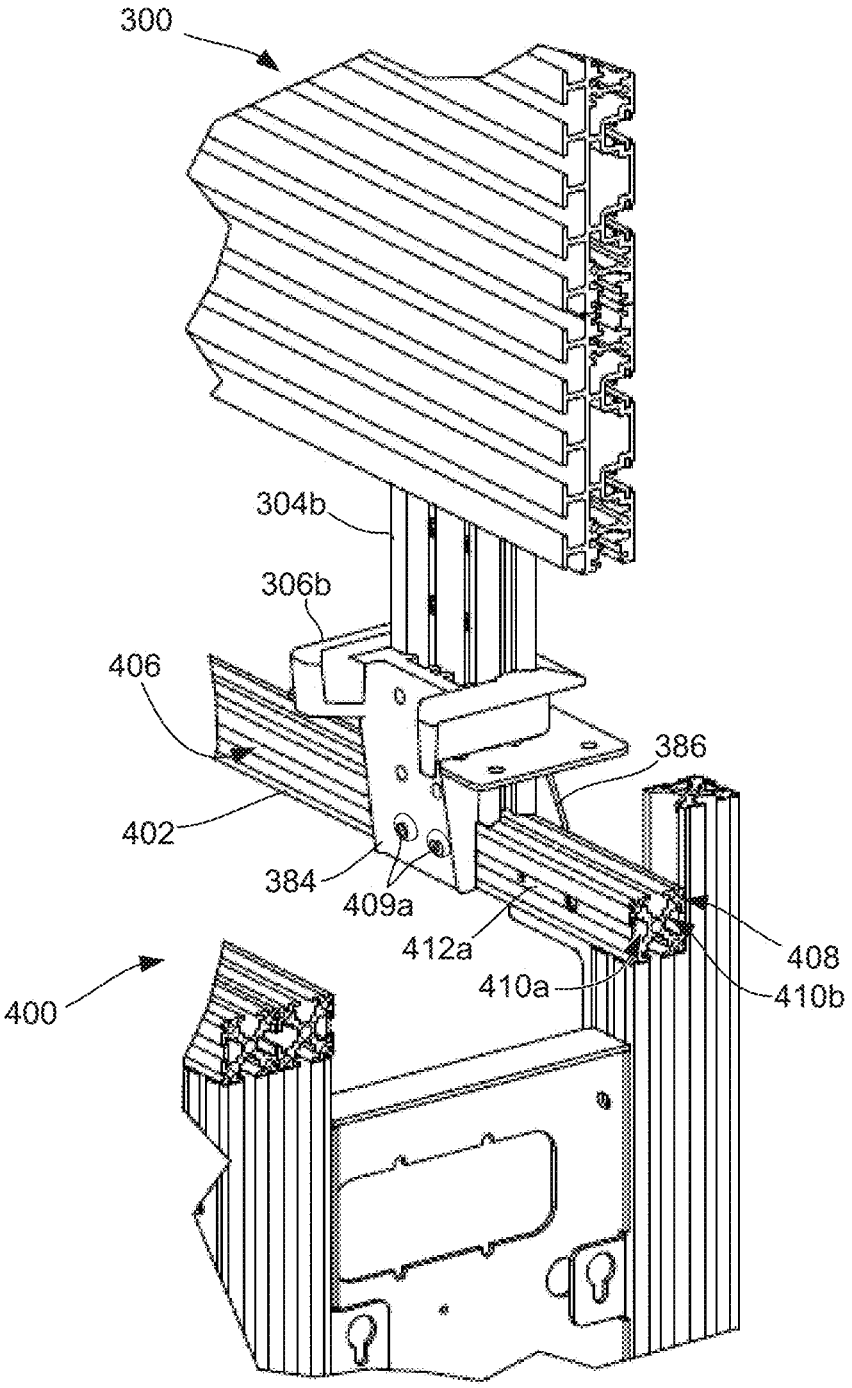
FIGS. 15 and 16 are enlarged partial front and rear perspective views of the slat wall assembly and the frame module of FIGS. 13 and 14.
Figure 16:
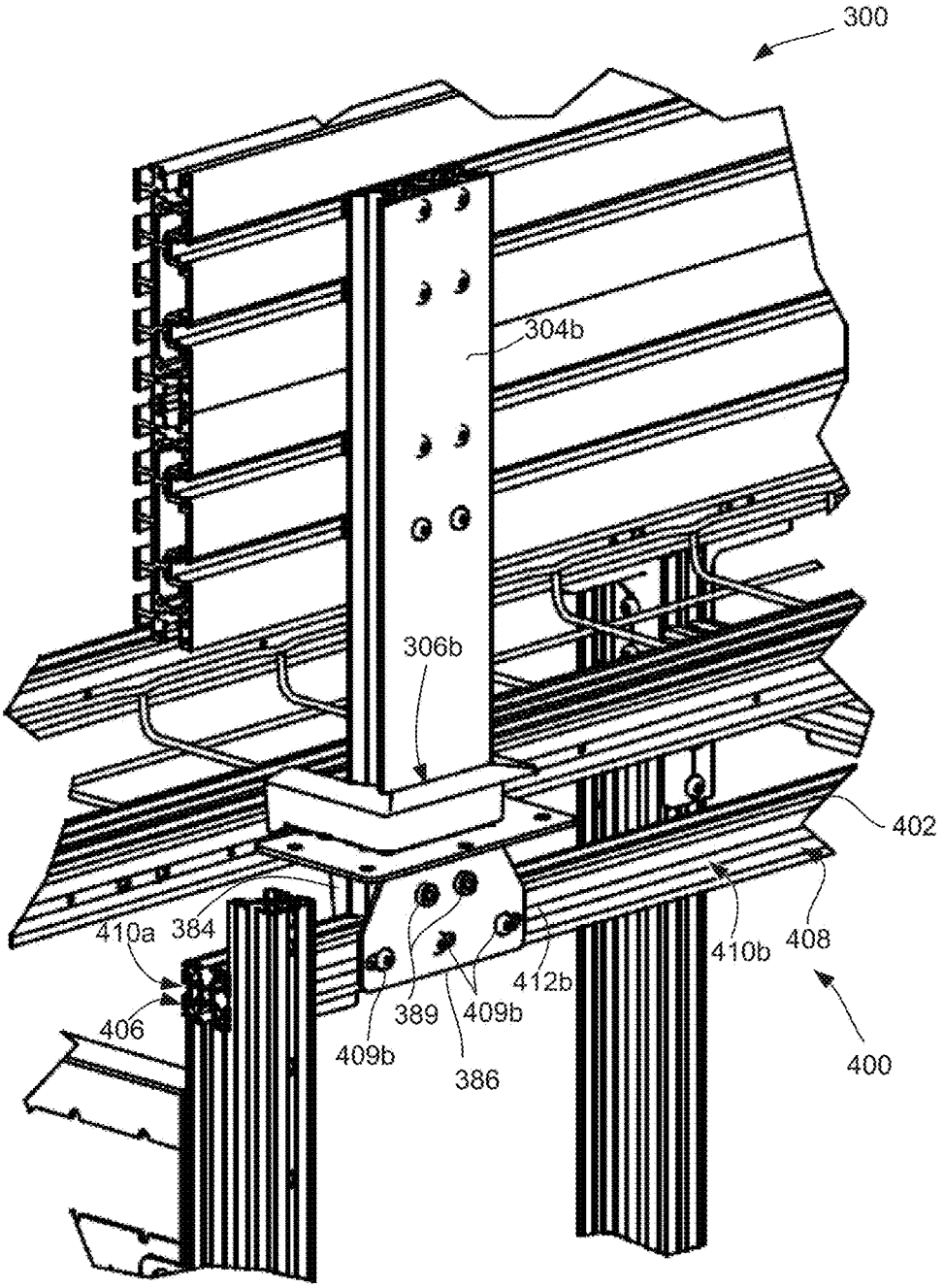

FIG. 15 is an enlarged partial front perspective view of the slat wall assembly 300 and the frame module 400 of FIGS. 13 and 14, showing the area generally within the area "I" identified in FIG. 13. FIG. 16 is an enlarged partial rear perspective view of the slat wall assembly 300 and the frame module 400 of FIGS. 13 and 14, showing the area generally within the area "J" identified in FIG. 14.

The second upright support member 304*b* and the second connector 306*b* are shown in FIGS. 15 and 16. The front and rear plates 384 and 386 of the second connector 306*b* fit over the front 406 and rear 408 of the beam 402 of the frame module 400 (similar to a clamp). In this particular example, the beam 402 is an extrusion with a generally square or rectangular profile. The beam 402 defines elongated slot-like front and rear ports 410*a* and 410*b* that have front and rear attachment strips 412*a* and 412*b* received therein. Bolts 409*a* (FIG. 15) and bolts 409*b* (FIG. 16) extend through the front and rear plates 384 and 386, respectively, to engage the corresponding attachment strips 412*a* and 412*b* and secure the front and rear plates 384 and 386 to the beam 402. The second upright support member 304*b* sits over the beam 402 of the frame module 400. The front and back plates 384 and 386 together with the rectangular or square profile of the upper beam 402 of the frame module 400 may help prevent rotational or angular movement or misalignment of the second connector 306*b* and the second upright support member 304*b*.

The first upright support member 304*a* and the first connector 306*a* connect to the upper beam 402 of the frame module 400 in the same manner as the second upright support member 304*b* and the second connector 306*b*.

FIG. 17 is an enlarged front partial perspective view of the second connector 306*b* and the second upright support member 304*a* of FIGS. 15 and 16 attached to an upper beam 502 of another example frame module 500. An upper panel 504 (similar to upper panel 210 in FIG. 2) is mounted on the frame module 500. The upper panel 504 is received in the collar 374 of the second connector 306*b*, between the upper lip 381 and the lower plate 382 (shown in FIG. 6). The lower plate 382 attaches to the underside (not visible) of the upper panel 504. Thus, the collar 374 and the lower plate 382 may provide additional structural support for a console including the frame module 500 and upper panel 504. The upper panel 504 is shown by way of example only. A recess 520 in front of the front plate 384 and between the sides of the collar 374 may be used as a cable passageway. For example, cables from equipment mounted to the slat wall assembly 300 may extend down through the recess 520 to an interior of the console frame module 500.

Figure 18:
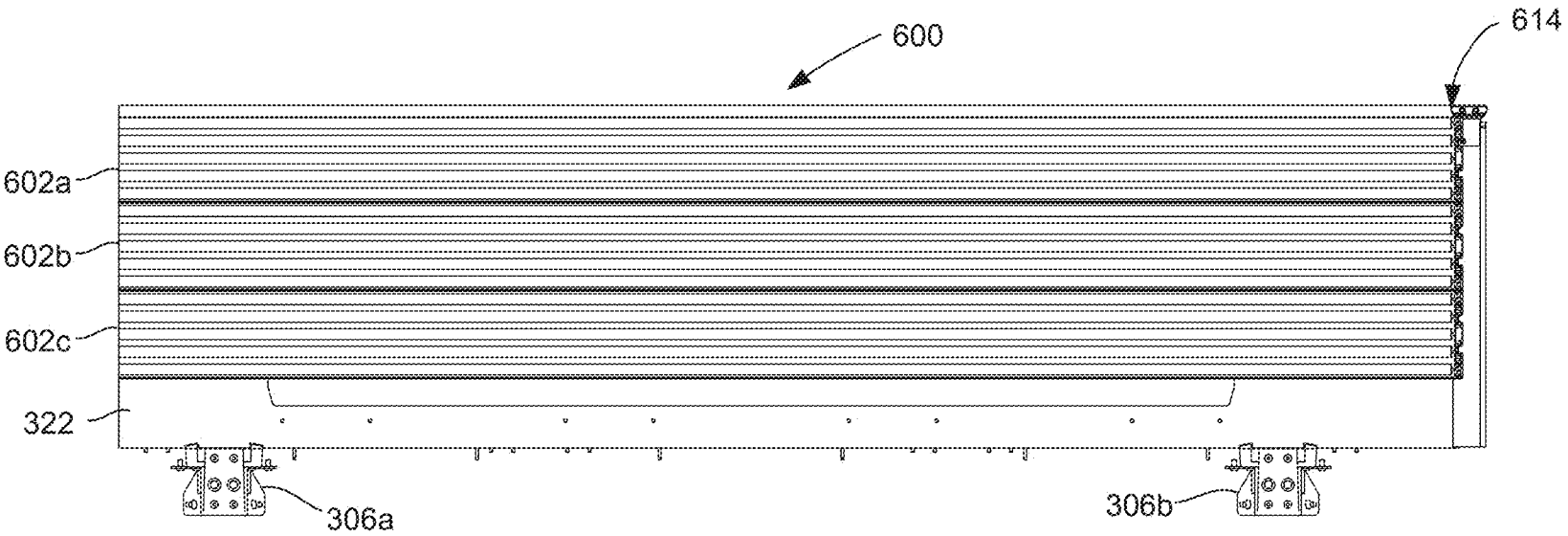
FIG. 18 is front view of a slat wall assembly according to another embodiment.

FIG. 18 is front view of a slat wall assembly 600 according to another embodiment. The slat wall assembly 600 includes first, second and third slat wall panels 602*a*, 602*b* and 602*c*. The three slat wall panels 602*a*, 602*b* and 602*c* are stacked. Other than the height and number of slat wall panels, the slat wall assembly 600 of FIG. 18 has the same basic structure as the slat wall assembly 300 of FIG. 3. For example, the slat wall assembly also includes a housing 614, similar to the housing 314 of the slat wall assembly 300 of FIG. 3, including front cover 322. Left and right side covers (not shown) of the housing are removed in FIG. 18. The slat wall assembly 600 also includes first and second connectors 306*a* and 306*b* for connecting the assembly 600 to a console or other structure.

Figure 19:
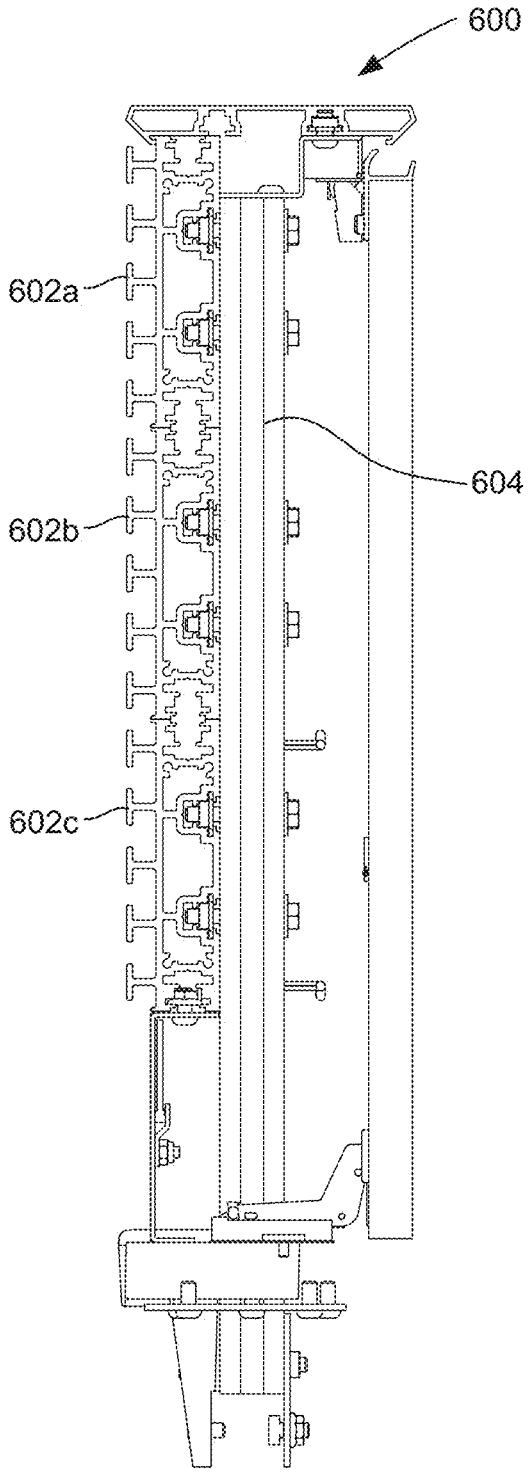
FIG. 19 is a right-side view of the slat wall assembly of FIG. 18.

FIG. 19 is a right-side view of the slat wall assembly 600 of FIG. 18 (with side covers removed). One of the upright support members 604 is visible. The first, second and third slat wall panels 602*a*, 602*b* and 602*c* are mounted to the upright support members 604, which are structurally similar to the upright support members 304*a* and 304*b* in FIG. 3, but taller.

Figure 20:
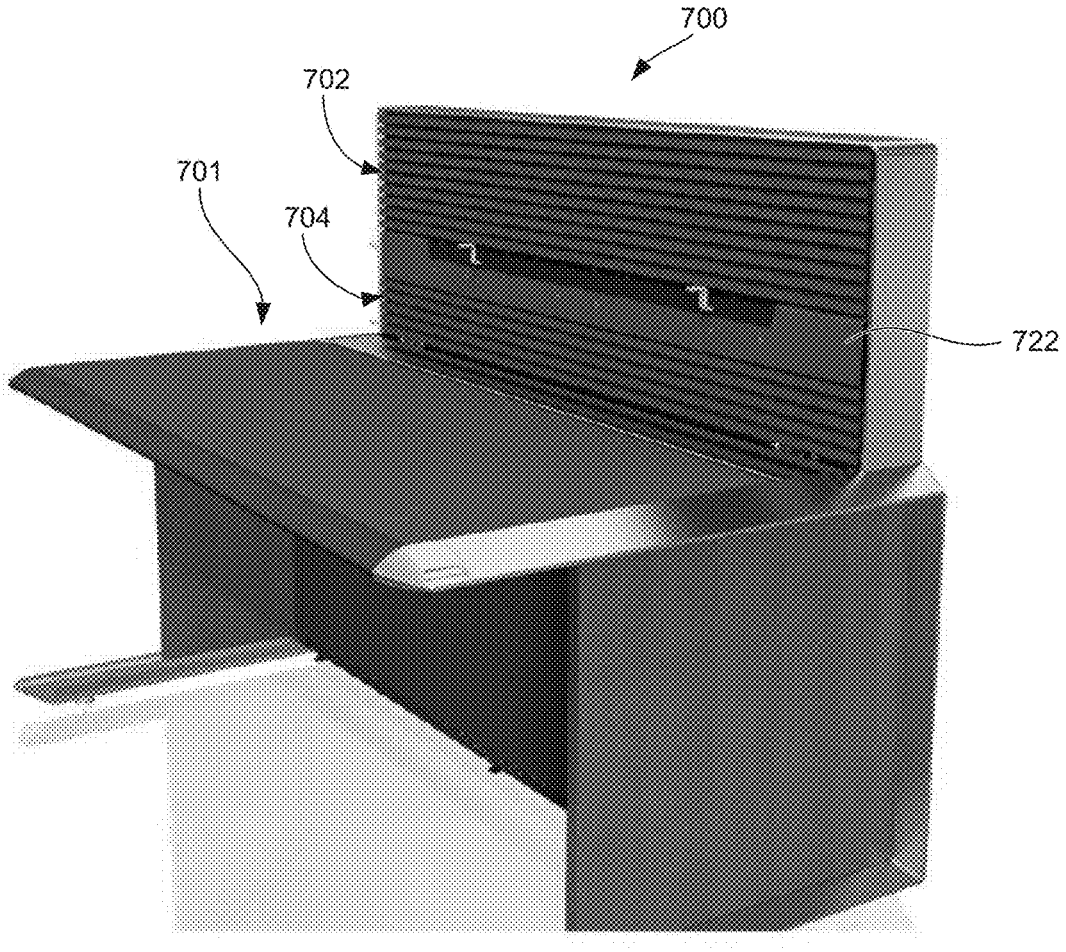
FIG. 20 is a front perspective view of an example console with a slat wall assembly according to another embodiment mounted thereon.

FIG. 20 is a front perspective view of an example console 701 with a slat wall assembly 700 according to another embodiment mounted thereon. The slat wall assembly 700 in this example is similar to the slat wall assembly 600 of FIGS. 18 and 19. However, the slat wall assembly 700 includes an upper slat wall section 702 (optionally comprised of two or more stacked slat wall panels) and a lower slat wall section 704 (optionally comprised of a single slat wall panel), with a front cover 722 therebetween. Other configurations as also possible, and embodiments are not limited to a particular slat wall arrangement shown in the drawings.

Figure 21:
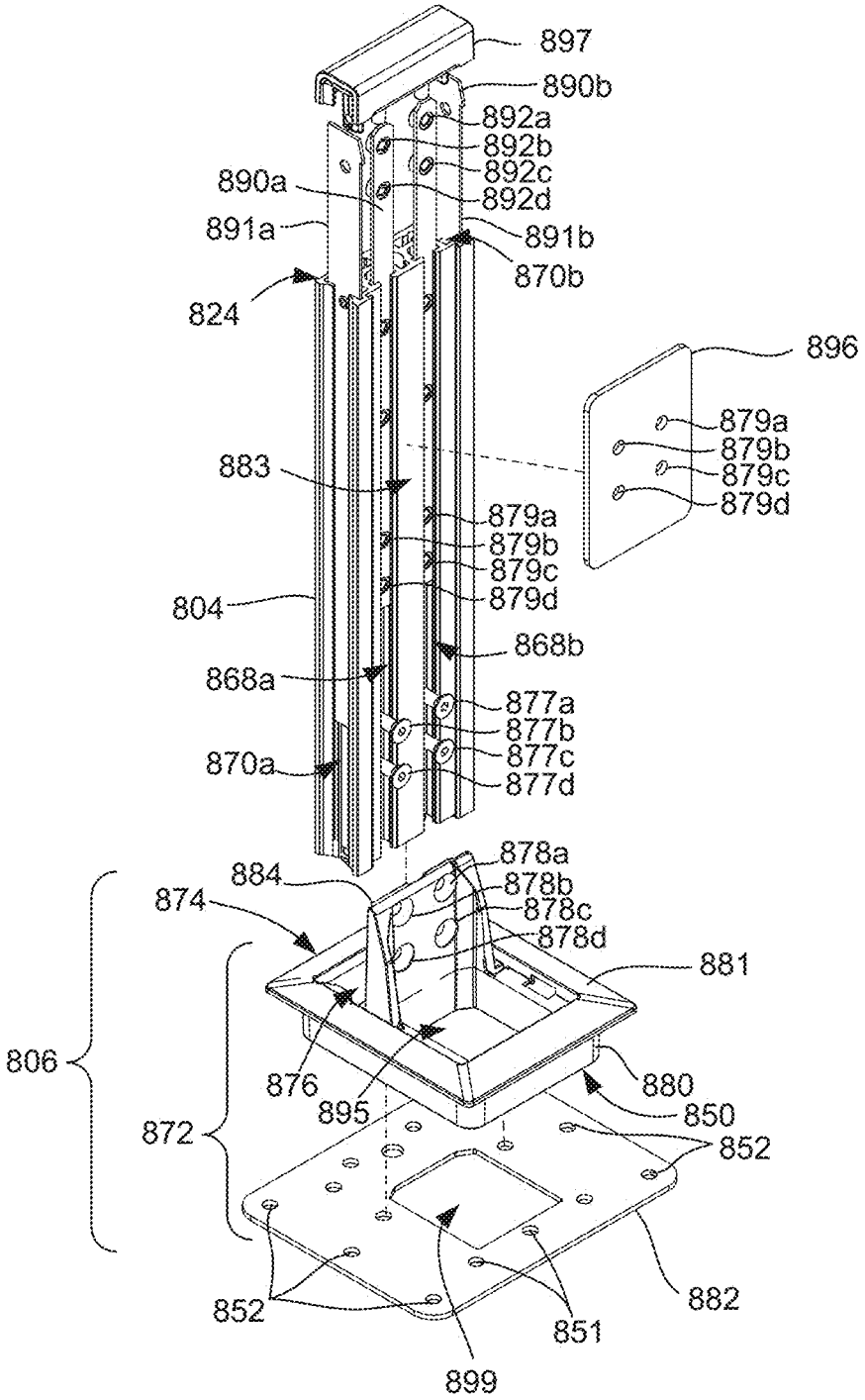
FIG. 21 is an exploded front perspective view of an upright support member and connector according to another embodiment.

FIG. 21 is an exploded front perspective view of an upright support member 804 and connector 806 according to another embodiment. The connector 806 may be used for mounting slat panel assembly, such as a slat wall assembly or a slat rail assembly to a console or other structure.

The upright support member 804 is an extrusion (e.g. aluminum) with essentially the same structure as the upright support member 304*b* in FIG. 6. Specifically, the upright support structure 804 defines two spaced apart, front facing elongated ports 868*a* and 868*b* (in the form of slots or channels) as well as first and second side ports 870*a* and 870*b*.

The connector 806 in this embodiment includes a collar portion 872 that comprises a collar 874 and a lower plate 882. As shown in FIG. 6, the collar 874 in this example is similar to the collar 374 in FIG. 6, including upper lip 881 and wall 880 extending between the upper lip 881 and the lower plate 882 to form a channel 875 (best seen in FIG. 22). However, the collar 874 in this embodiment extends completely around the periphery of the collar portion 872, in a rectangular loop shape. The lower plate 882 is secured to a bottom 850 of the wall 880 by screws (not shown) or other fastening means extending through an array of holes 851 in the lower plate 882 that are positioned to be spaced about the bottom 850 of the wall. The plate 882 includes additional holes 852 positioned for engaging the underside of a top panel (desktop) of a console or other similar structure.

The collar portion 872 defines a generally vertical passage 876 therethrough to receive the upright support member 804. The upright support member 804*a* is securable to the connector 806 (when received in the passage 876).

Rather than downward extending plates (e.g. plates 384 and 386 in FIG. 6), the connector 800 includes a plate 884 that extends upward from the collar portion 872 and is positioned to engage the front face 883 of the upright support member 804. Attachment strips 890*a* and 890*b* received in the front facing ports 868*a* and 868*b* of the upright support member 804. Bolts 877*a* to 877*d* are received through holes 878*a* to 878*d* respectively, and then engage the corresponding holes/self-cinching nuts 879*a* to 879*d* in attachment strips 890*a* and 890*b*. The bolts 877*a* to 877*d* and attachment strips 890*a* and 890*b*, thus, secure the upright support member 804 to the connector 806. The attachment strips 891*a* and 891*b* in FIG. 21 may be used to connect a cover (e.g. cover 1107*a* in FIG. 32) to the upright support member 804.

The connector 806 defines another passage 895 therethrough (in front of the upward extending plate 884) through which cables, wires or other such equipment may pass. For example, cables connected to equipment mounted to a slat wall or slat rail may pass through the passage 895 into the interior of the console (or other furniture) to which the connector 806 is mounted. The lower plate 882 defines a hole 899 therethough aligned with passage 895.

One or more slat wall panels (such as panels 302*a* and 302*b* in FIG. 3) or a slat rail may be mounted to the upright support member 804. In this embodiment, the attachment strips 890*a* and 890*b* include holes 892*a* to 892*d* that are specifically positioned for mounting to a slat rail (such as slat rail 1102 shown in FIG. 25). Optionally, a spacer 896 may be positioned between the upright support member 804 and the slat rail. Holes 879*a* to 879*d* of a spacer 896 align with holes 892*a* to 892*d*, so that the fastening hardware (e.g. bolts) that secures the slat rail to the upright support member 804 also secures the spacer 896.

As will be appreciated, the attachment strips 890*a* and 890*b* may be swapped out with different strips (e.g. strips 390*a* and 390*b* from FIG. 6) depending on the desired configuration and function of the upright support member 804.

In this example, a top end cap 897 is received into a top end 824 of the upright support member 804. The top end cap 897 is optional and may be omitted. For example, where the upright support member is used in conjunction with an assembly housing (e.g. slat wall housing 314 in FIG. 3), the top cap may be replaced with a bracket for attaching a top cover (e.g. bracket 326*a* and top cover 320 in FIG. 3)

Figure 22:
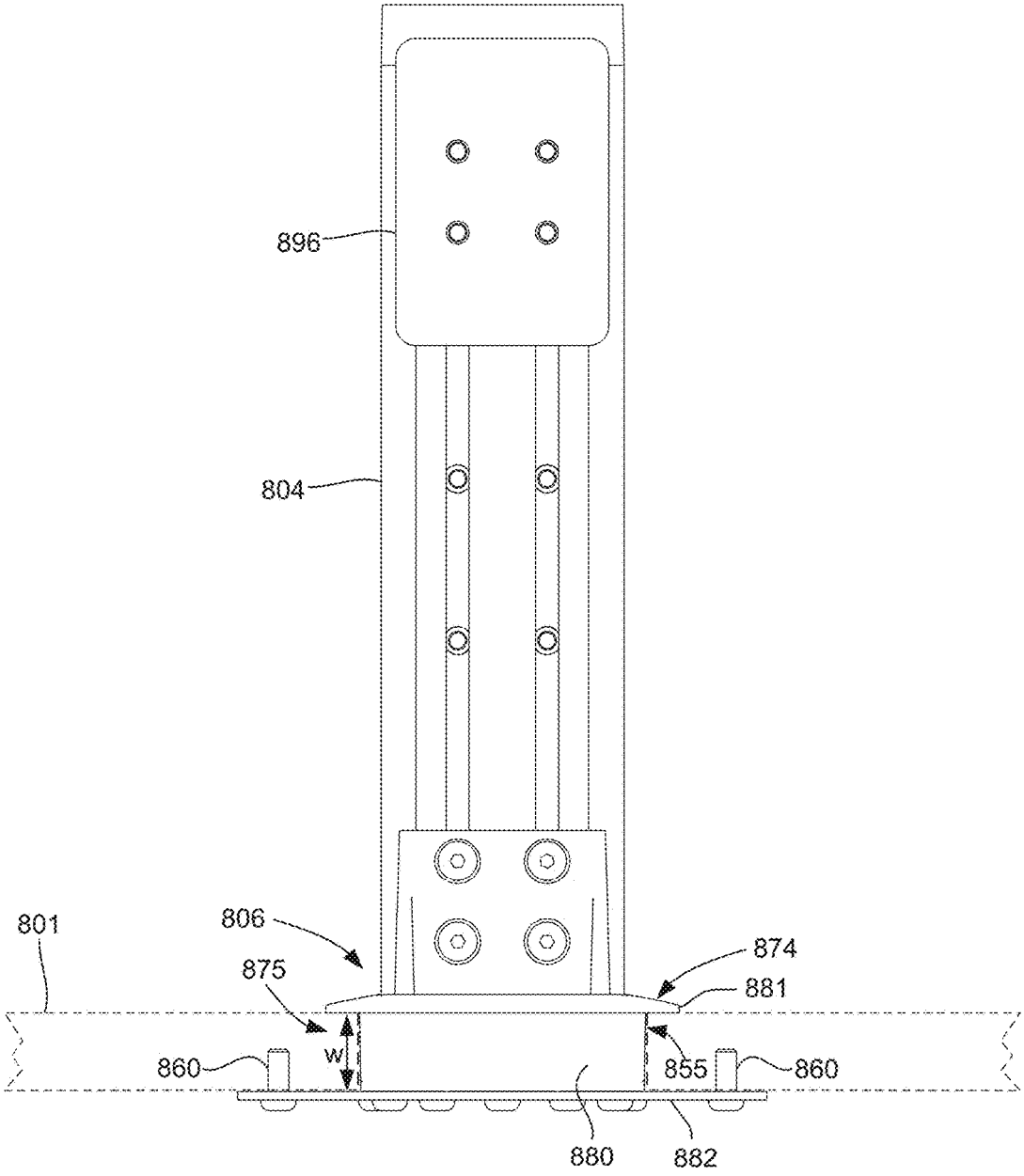
FIG. 22 is a front view of the connector and upright support member of FIG. 21.

FIG. 22 is a front view of the connector 806 and upright support member 804. The spacer 896 is shown attached to the upright support member. The channel 875 extending around the periphery of the collar 874 is also visible. The channel has a width w that is sized to match the thickness of a top panel 801 (e.g. work surface panel), which is shown as transparent with stippled lines for illustrative purposes of a console. The wall 880 may extend through a hole 855 or other recess in the top panel (e.g. desktop) of a console such that the upper lip 881 sits on the upper surface of the top panel, and the lower plate engages the underside of the top panel. The lower plate may be secured to the underside of the top panel (e.g. by screws 860 or any other suitable securing means).

Figure 23:
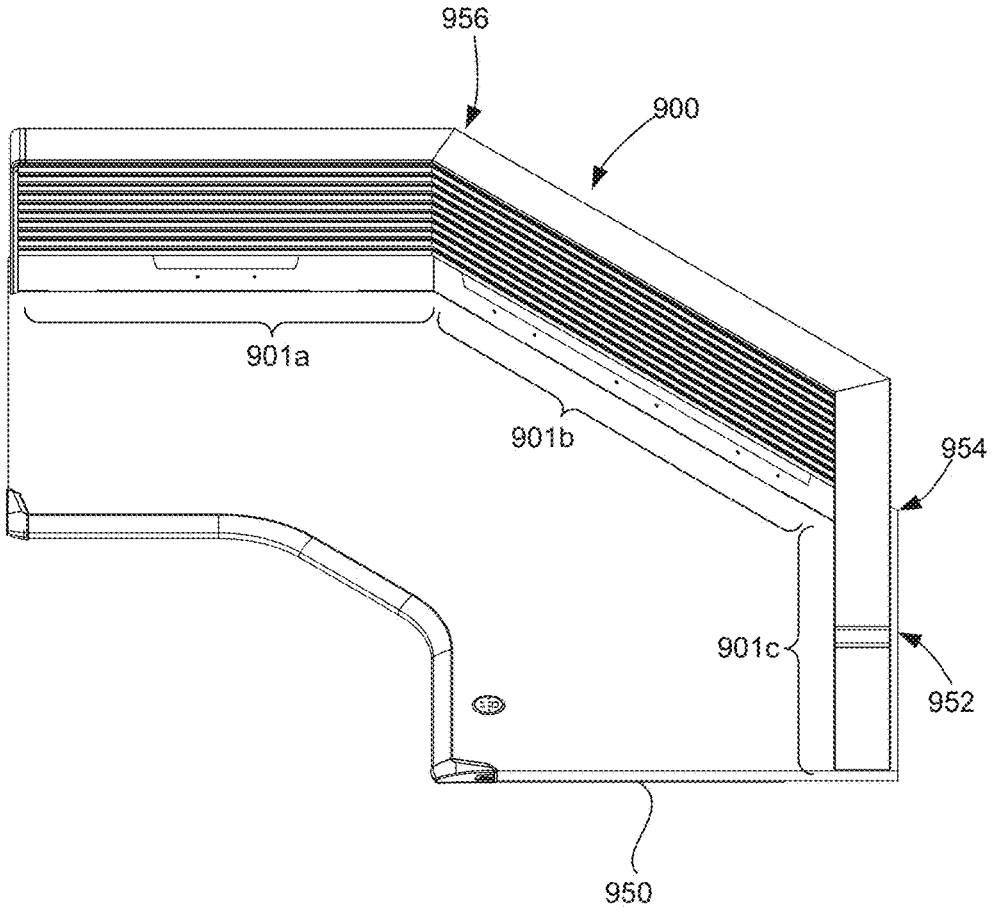
FIG. 23 is a top perspective view of a slat wall assembly according to another embodiment mounted on an example work surface panel for a console.

Slat wall assemblies may include two or more sections that are angled with respect to each other. For example, FIG. 23 is a top perspective view of a slat wall assembly according to another embodiment mounted on an example work surface panel 950 for a console (not shown) having a back edge 952 with two angled corners 954 and 956 that are each 45 degrees, for a total of 90 degrees. The console with work surface panel 950 may, for example, fit in a corner of a room. The slat wall assembly 900 conforms to the back edge 952 of the work surface panel 901 and includes a first section 901*a*, a second section 901*b* angled 45 degrees to the first section 901*a*, and a third section 901*c* angled 45 degrees to the second section 901*b*. Each section 901*a*, 901*b* and 901*c* is similar in form and function to the slat wall assembly 300 shown in FIG. 3, but joined at the angled corners 954 and 956.

Figure 24:
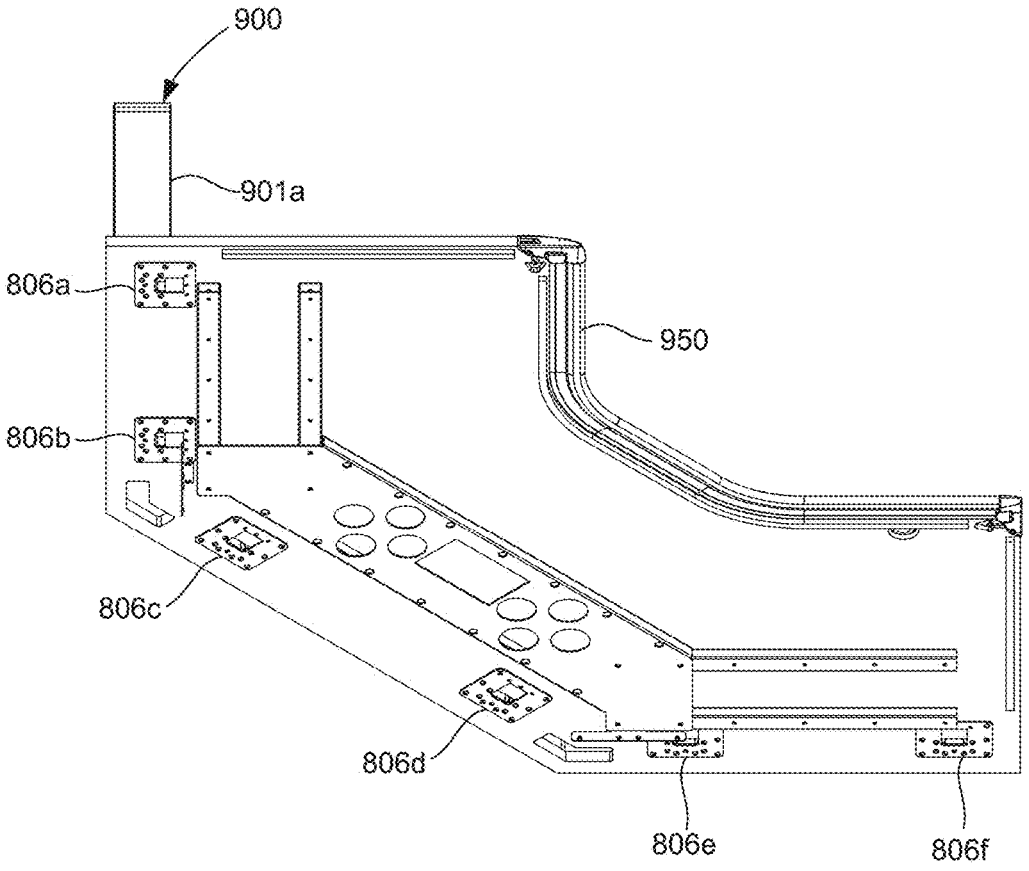
FIG. 24 is a bottom perspective view of the work surface panel and the slat wall assembly of FIG. 23.

FIG. 24 is a bottom perspective view of the work surface panel 950 and the slat wall assembly 900. As shown, the slat wall assembly is mounted to the work surface panel 950 by connectors 806*a* to 806*f*, which each connect the work surface panel 950 to a respective upright support member (not shown). The connectors 806*a* to 806*f* are each similar in structure and function to the connector 806 shown in FIGS. 21 and 22. First and second connectors 806*a* and 806*b* attach the first slat wall assembly section 901*a*. Third and fourth connectors 806*c* and 806*d* attach the second slat wall assembly section 901*b* (shown in FIG. 23). Fifth and sixth connectors 806*e* and 806*f* attach the third slat wall assembly section 901*c* (shown in FIG. 23).

Figure 25:
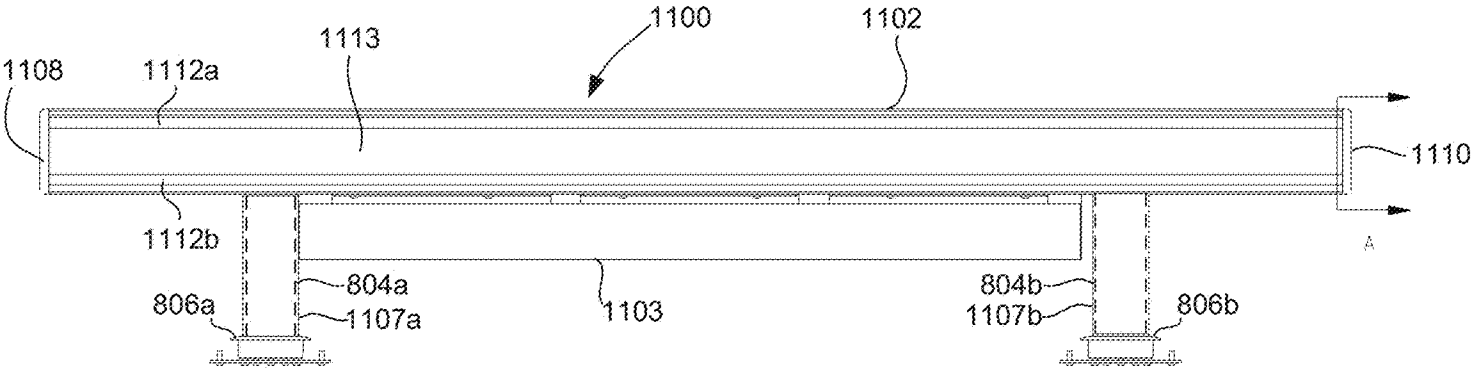
FIG. 25 is a front view of a slat rail assembly according to some embodiments.

FIG. 25 is a front view of a slat rail assembly 1100 according to some embodiments that may be mounted on a console or other structure. The slat rail assembly 1100 includes a slat rail 1102 and a cable management enclosure 1103 mounted below the slat rail 1102. The slat rail 1102 in this example is mounted on first and second upright support members 804*a* and 804*b* (each the same structure as upright support member 804 in FIGS. 21 and 22) that are in turn attached to connectors 806*a* and 806*b* (each the same structure as connector 806 in FIGS. 21 and 22). Optional upright support covers 1107*a* and 1107*b* are included covering the upright support members 804*a* and 804*b*. Thus, the upright support members 804*a* and 804*b* are shown through the covers 1107*a* and 1107*b* with stippled lines in FIG. 25 to indicate that they would not be visible.

Optional first and second end caps 1108 and 1110 are received in opposite ends of the slat rail 1102. The slat rail 1102 has an upper slat 1112*a* and a lower slat 1112*b* spaced apart from the upper slat 1112*a*. In this embodiment, an aesthetic strip insert 1113 is included between the upper slat 1112*a* and the lower slat 1112*b*. The upper and lower slats 1112*a* and 1112*b* are shaped for mounting various equipment (e.g. displays, etc.). For example, a mount or bracket attached to such equipment may securely engage the slats 1112*a* and 1112*b*. The slats 1112*a* of the slat rail 1102 in FIG. 25 may be spaced such that a mounting bracket suitable for mounting equipment to the slat wall panels 302*a* or 302*b* in FIG. 3 (or other slat wall panels shown herein) may also be suited to engage the slat rail 1102.

The slat rail assembly in FIG. 25 may use connectors 306*a* and 306*b* shown in FIG. 3, rather than connectors 806*a* and 806*b*. In that case, the slat rail may be mounted to a console frame (similar to the beam 402 of the frame module 400 in FIGS. 15 and 16). Other embodiments may be mounted using still different methods. Embodiments are not limited to the particular methods of mounting the slat rail and slat wall assemblies shown in the drawings.

Figure 26:
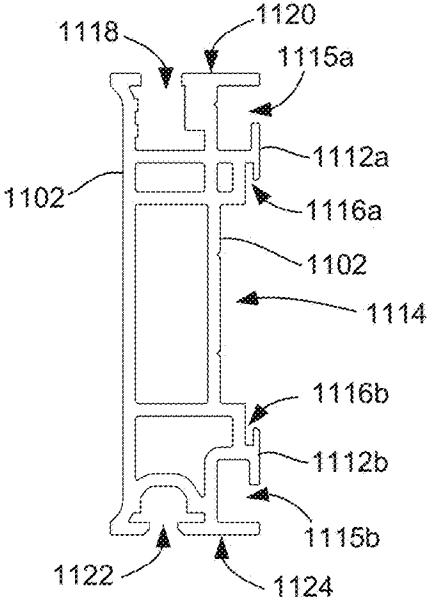
FIG. 26 is an end view of the slat rail of the slat rail assembly of FIG. 25.

FIG. 26 is an end view of the slat rail 1102 of the slat rail assembly 1100 of FIG. 25. The end caps 1108 and 1110 and the insert 1113 (shown in FIG. 25) are removed in FIG. 26. The profile of the upper and lower slats 1112*a* and 1112*b* on the front face 1114 of the slat rail 1102 is shown. In this example, the slat rail 1102 is a metal extrusion (e.g. aluminum) although embodiments are not limited to extrusions or any particular material. For example, one or more slats may be formed separately and attached to a panel in a spaced apart manner.

The upper slat 1112*a* defines upper slat recess 1115*a* for receiving a mount or bracket (e.g. a bracket for mounting a display). Similarly, the lower slat 1112*b* defines lower slat recess 1115*b*. The upper and lower slats 1112*a* and 1112*b* also define smaller recesses 1116*a* and 1116*b* opposite to the slat recesses 1115*a* and 1115*b*. The slat rail 1102 defines an elongate top port 1118 along its top 1120 and an elongate bottom port 1122 along its bottom 1124. The bottom port 1112 receives fastening hardware to attach the cable management enclosure 1103 shown in FIG. 25.

Figure 27:
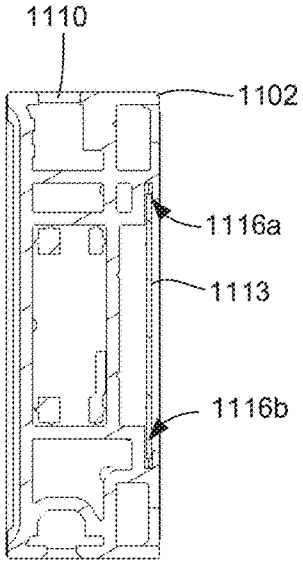
FIG. 27 is a cross-sectional view of the slat rail of the slat rail assembly of FIG. 25 taken along the line A-A.

FIG. 27 is a cross-sectional view of the slat rail 1102 of the slat rail assembly 1100 of FIG. 25 taken along the line A-A in FIG. 25, including the end cap 1110 and insert 1113. The insert 1113 may be laminate, metal, wood, or any other suitable material. The insert 1113 may be swappable and replaceable to customize the appearance of the slat rail 1102.

Figure 28:
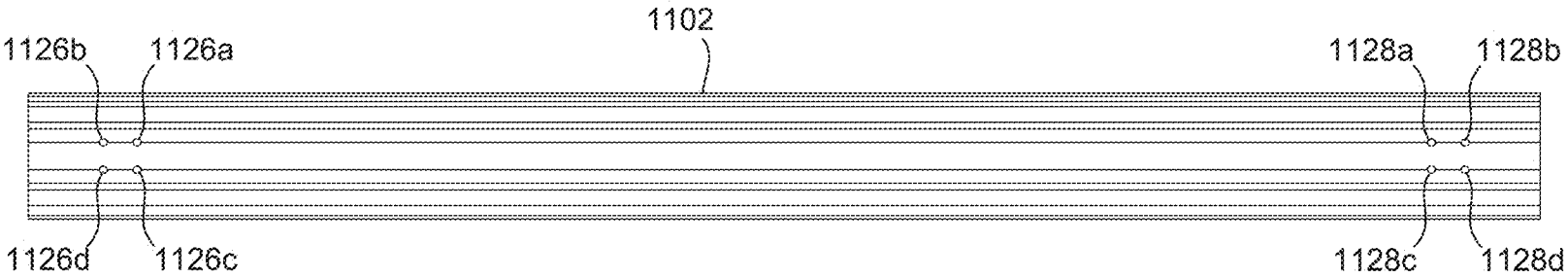
FIG. 28 is a front view of the slat rail of FIGS. 25 to 27.

FIG. 28 is a front view of the slat rail 1102 of FIGS. 25 to 27 with the insert 1113 and end caps 1108 and 1110 removed. With the insert 1113 removed, a first set of four holes 1126*a* to 1126*d* and a second set of four holes 1128*a* to 1128*d* are visible. The first set of holes 1126*a* to 1126*d* receive bolts (not shown) to secure the slat rail to the first upright support member 804*a*. The bolts extend through the spacer 896 and engage holes 892*a* to 892*d* of attachment strips 890*a* and 890*b* in FIGS. 21 and 22. Additional bolts (not shown) in the second set of holes 1128*a* to 1128*d* of the slat rail 1102 attach the slat rail 1102 to the second upright support member 804*b* in a similar manner.

Figure 29:
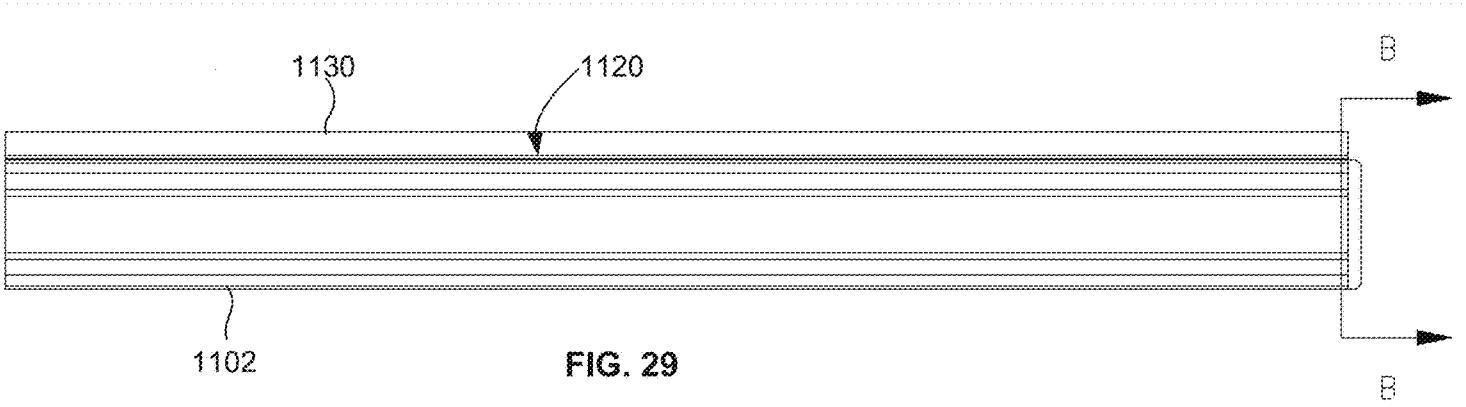
FIG. 29 is a front view of the slat rail of FIGS. 25 to 28 with an attachment strip attached to the top thereof.

FIG. 29 is a front view of the slat rail of FIGS. 25 to 28 with an attachment strip 1130 attached to the top 1120 thereof. The attachment strip is for holding a panel (e.g. glass or plexiglass panel) above the slat rail 1102.

Figure 30:
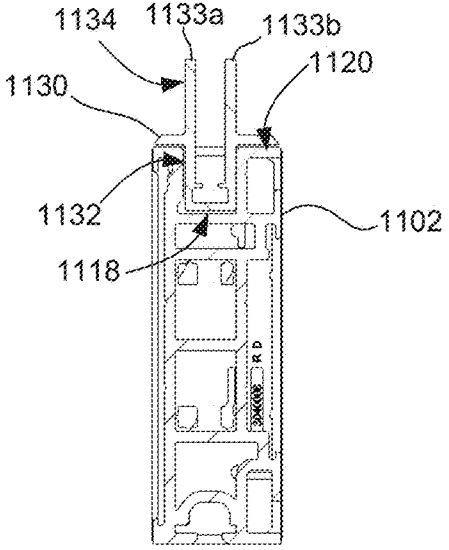
FIG. 30 is a cross-sectional view of the slat rail of FIG. 29 taken along the line B-B.

FIG. 30 is a cross-sectional view of the slat rail 1102 taken along the line B-B in FIG. 29. As shown in FIG. 30, the attachment strip includes spaced apart wall-like extensions 1133*a* and 1133*b*. A lower portion 1132 of the strip 1130 extends into the top port 1122 of the slat rail 1102. An upper portion 1134 of the strip extends above the slat rail 1102. The extensions 1133*a* and 1133*b* may receive a panel therebetween (such as the plexiglass panels 1235 and 2006 shown in FIGS. 35 and 39). The panel may thereby be mounted on the slat rail 1102.

Figure 31:
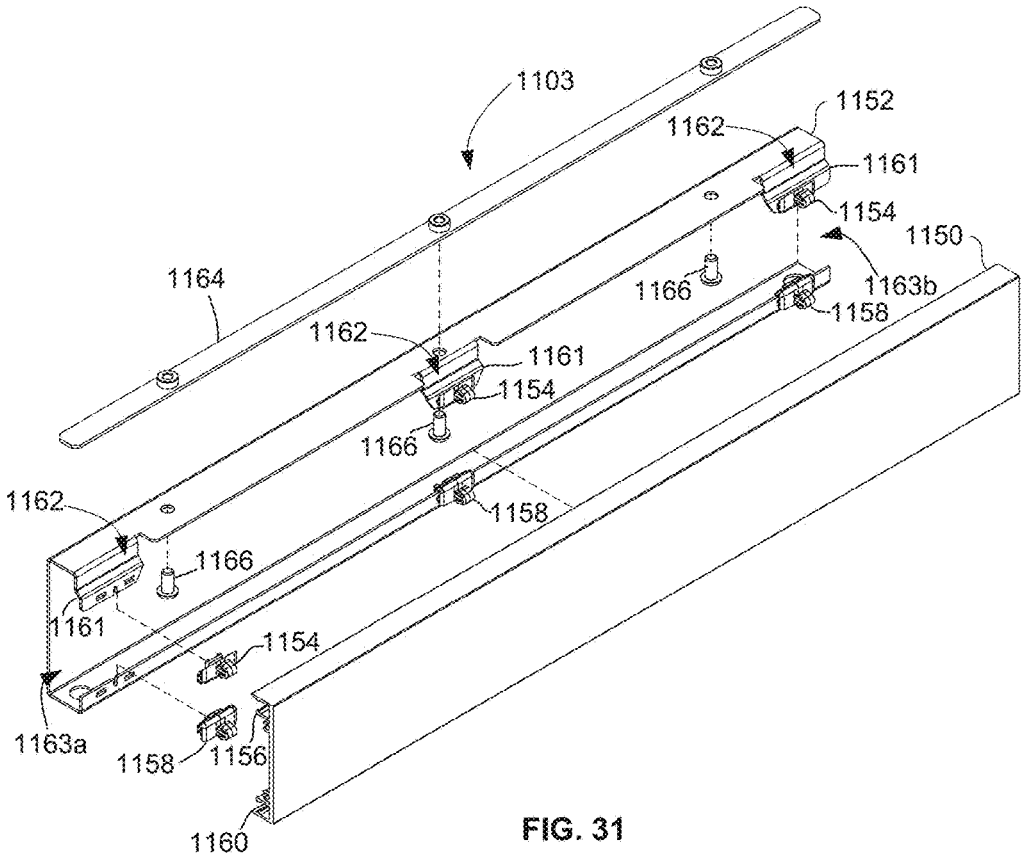
FIG. 31 is a front perspective view of the example cable management enclosure of FIG. 25.

FIG. 31 is a front perspective view of the example cable management enclosure 1103 of FIG. 25. As shown, the cable management enclosure 1103 includes a front piece 1150 and a rear piece 1152 that assemble to form a generally rectangular enclosure. Upper snap clips 1154 of the rear piece 1152 are positioned to engage upper gripping strip 1156 of the front piece 1150. Similarly, lower snap clips 1158 of the rear piece 1152 are positioned to engage lower gripping strip 1160 of the front piece 1150. The upper snap clips 1154 are attached to brackets 1161 that extend down into the enclosure 1103 at upper openings 1162. The enclosure 1103 also has open ends 1163*a* and 1163*b*.

Attachment strip 1164 shown in FIG. 31 is received in the bottom port 1122 (FIG. 26) and receives bolts 1166 to secure the cable management enclosure 1103 to the slat rail 1102 (FIG. 26).

An example cable pathway will now be described with reference to FIGS. 21, 25, and 31. Cables (not shown) from equipment mounted on the slat rail 1102 (FIG. 25) may enter the enclosure 1103 through the upper openings 1162 and exit the enclosure 1103 through the open ends 1163*a* and 1163*b*. From the open ends 1163*a* and 1163*b*, the cables may pass through an opening (not shown) in the corresponding covers 1107*a* and 1107*b* (FIG. 25) of the upright supports 804*a* and 804*b* (FIG. 25) and continue through the passages 895 (FIG. 21) of the connectors 806*a* and 806*b* into the interior of a console to which the slat rail 1102 is mounted.

Figure 32:
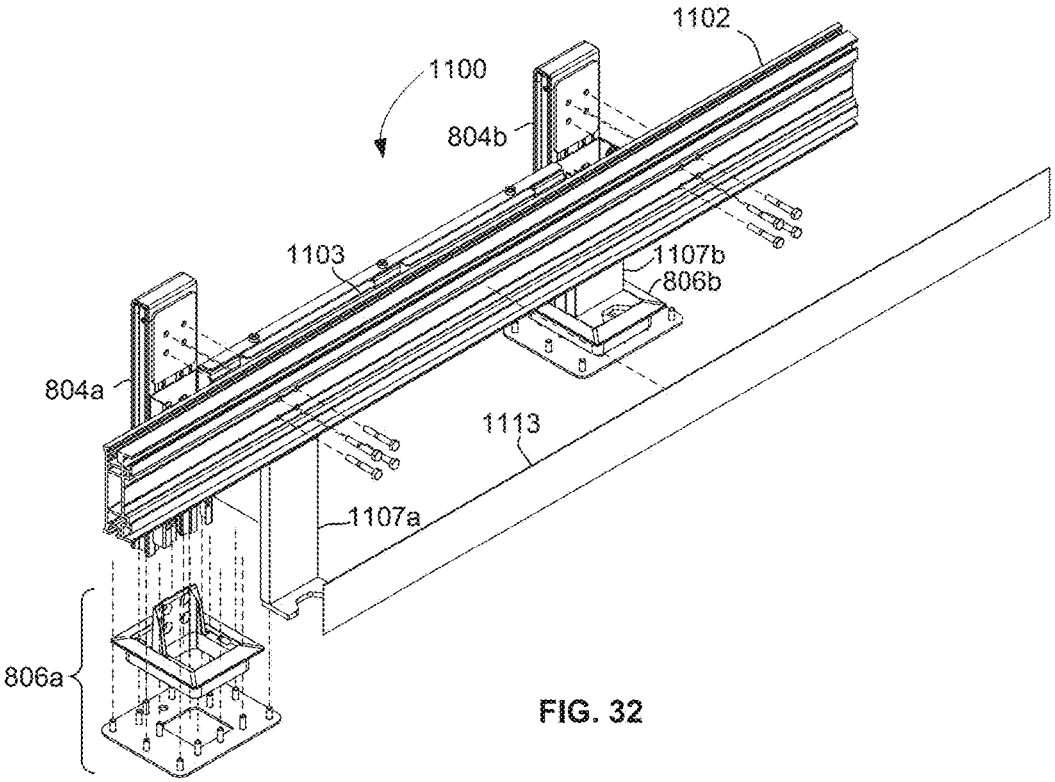
FIG. 32 is an exploded front perspective view of the slat rail assembly of FIG. 25.

FIG. 32 is an exploded front perspective view of the slat rail assembly 1100 of FIG. 25 including: the first and second upright supports 804*a* and 804*b*; the first and second connectors 806*a* and 806*b*; the first and second upright support covers 1107*a* and 1107*b*; the strip insert 1113; and the cable management enclosure 1103. End caps 1108 (FIG. 25) are removed in FIG. 32.

Figure 33:
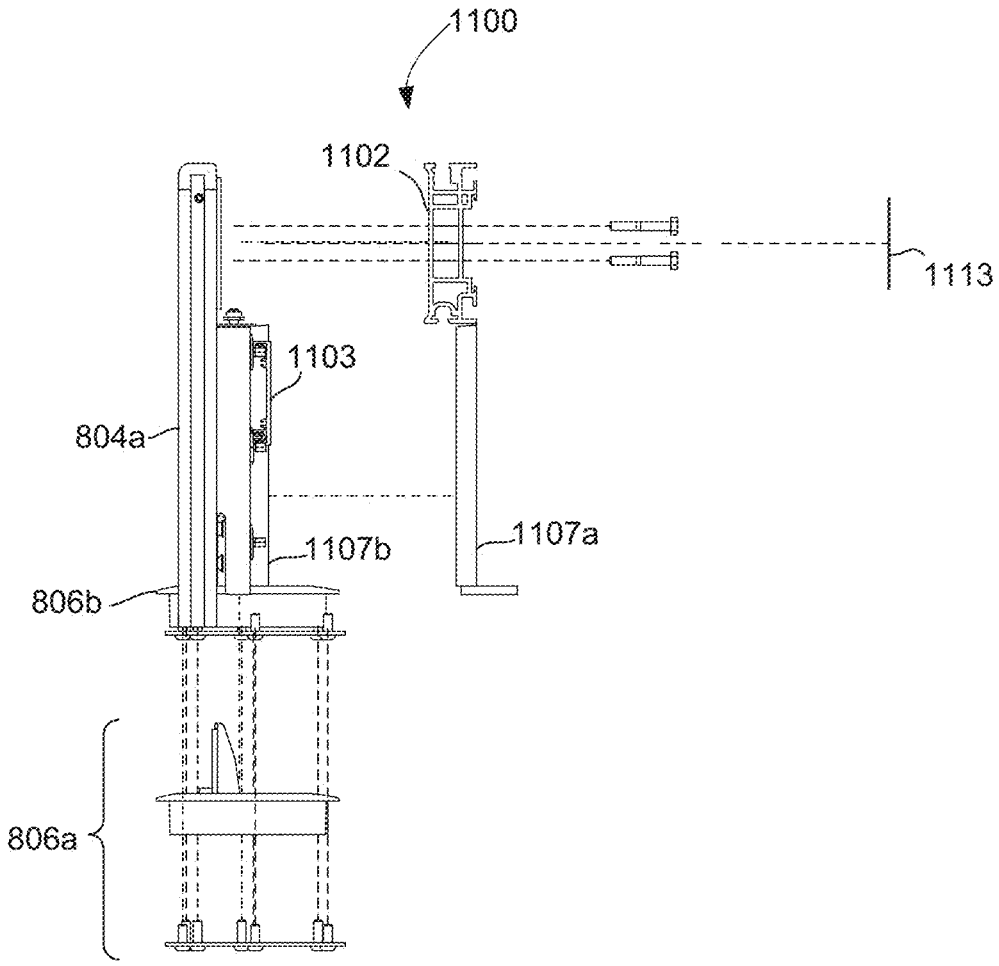
FIG. 33 is a partially exploded left side view of the slat rail assembly of FIGS. 25 and 32.

FIG. 33 is a partially exploded left side view of the slat rail assembly 1100 of FIG. 25 including: the first upright support 804*a*; the first and second connectors 806*a* and 806*b*; the first and second upright support covers 1107*a* and 1107*b*; the strip insert 1113; and the cable management enclosure 1103. End caps 1108 (FIG. 25) are removed in FIG. 33.

Figure 34:
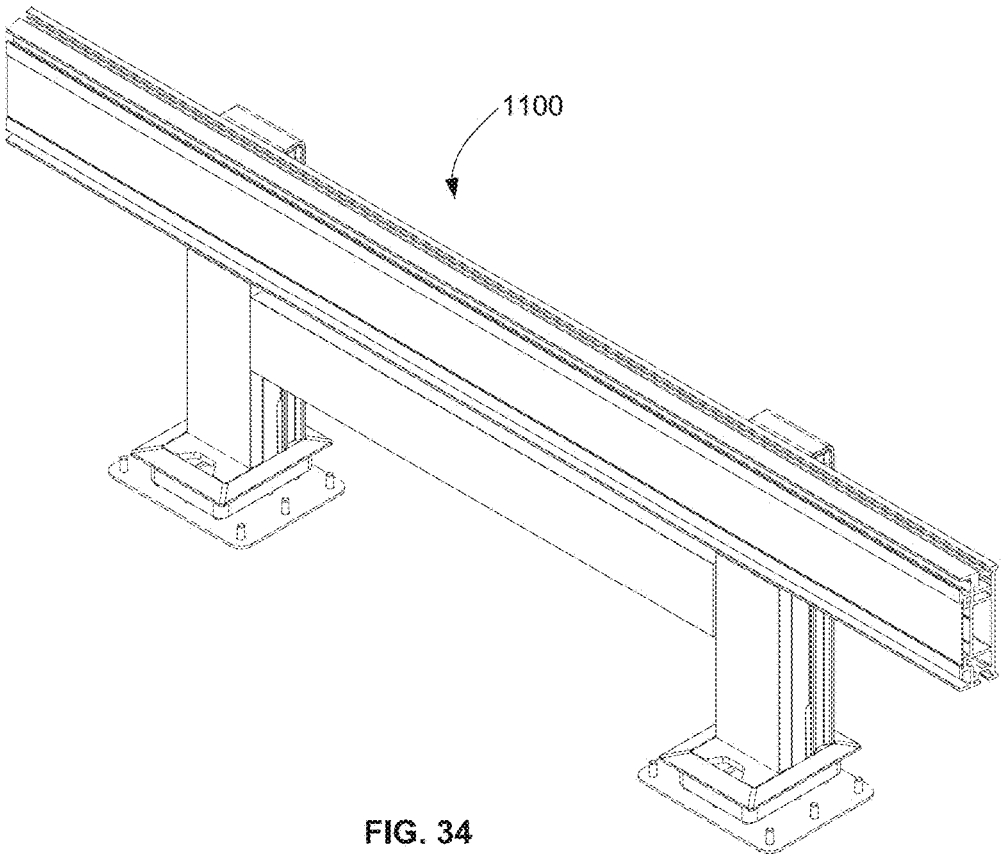
FIG. 34 is a front perspective view of the slat rail assembly of FIGS. 25, 32 and 33, as assembled.

FIG. 34 is a front perspective view of the slat rail assembly 1100 of FIGS. 25 and 33, as assembled.

Figure 35:
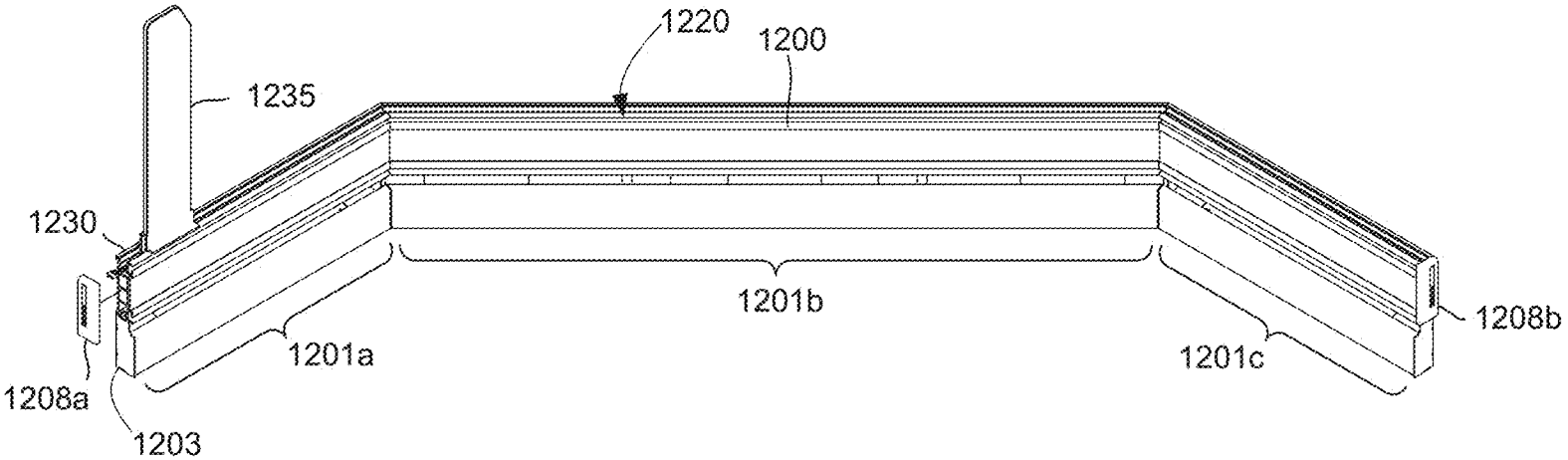
FIG. 35 is a front perspective view of a slat rail according to yet another embodiment.

FIG. 35 is a front perspective view of a slat rail 1200 according to yet another embodiment. The slat rail includes three sections 1201*a*, 1201*b* and 1201*c* attached in series that are angled with respect to one another. A cable management enclosure 1203 that is similarly angled is attached below the slat rail 1200. An attachment strip 1230, similar to the attachment strip 1130 in FIG. 29, is attached to the top 1220 of the slat rail 1200. This embodiment includes a vertically aligned edge-lit panel 1235 (e.g. plexiglass or another transparent or translucent material) mounted to the attachment strip 1230. The panel may be edge-lit by one or more LEDs or LED strips. In other embodiments, the panel may not be edge-lit. The edge-lit panel 1235 in this example is relatively short compared to the slat rail 1200, but in other embodiments, edge-lit panels may extend the entire length of the slat rail 1200 or more. End caps 1208*a* and 1208*b* of the slat rail 1200 are shown (with one end cap 1208*a* shown unattached)

Figure 36:
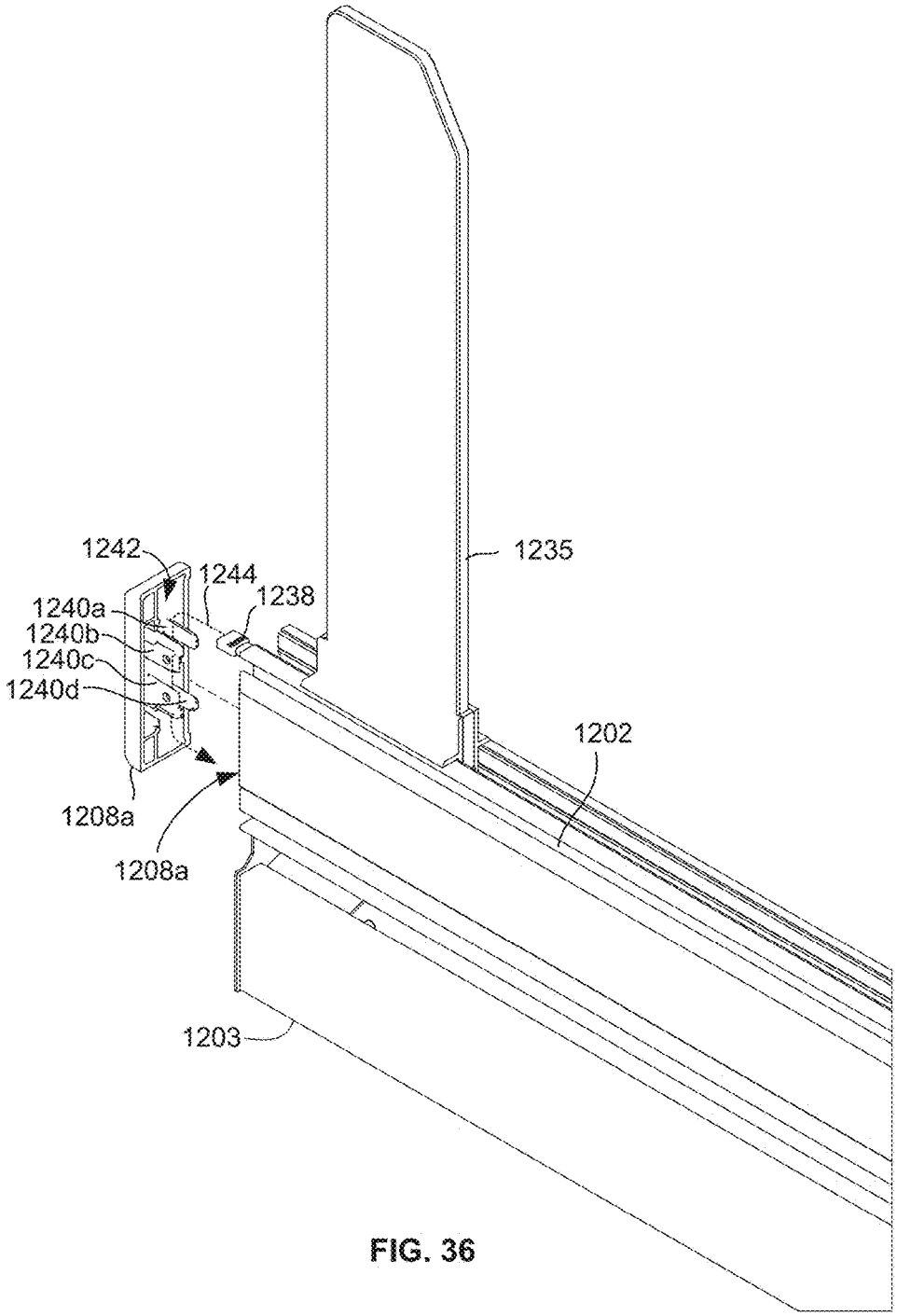
FIG. 36 is an enlarged partial view of the slat rail of FIG. 35.

FIG. 36 is an enlarged partial view of the slat rail 1200, cable management enclosure 1203 and edge-lit panel 1235 of FIG. 35. The end cap 1208*a* includes extensions 1240*a* to 1240*d* that are securely received into the end 1241 of the slat rail 1200. The end cap defines a channel 1242 between the extensions 1240*a* to 1240*d*. The channel 1242 functions as a pathway for cable 1238 of the edge-lit panel. The cord 1238 is a power/driving signal input for driving the lighting elements (not shown) of the edge-lit panel 1235. The cable 1238 may follow the path shown by the stippled line arrow marked 1244. Then, after exiting the end cap 1208*a*, the cable 1238 may continue into the cable management enclosure 1203 or elsewhere (e.g. behind an upright support member cover and into a console).

Figure 37:
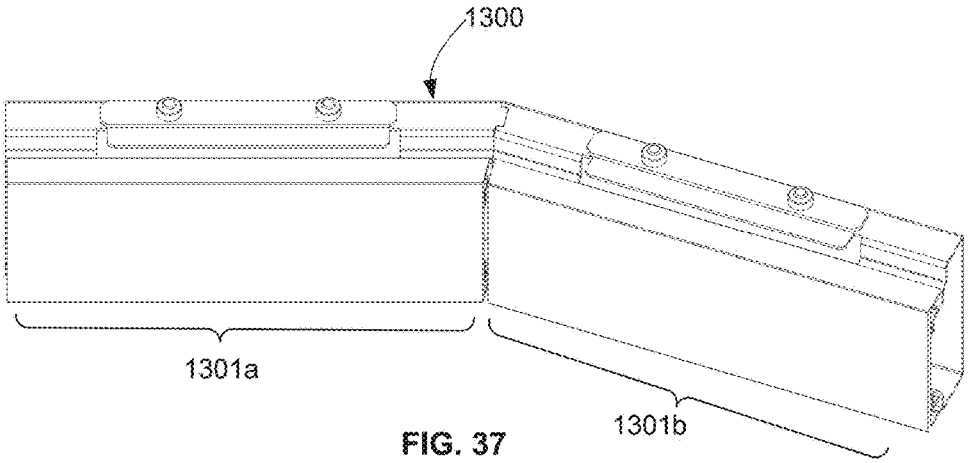
FIG. 37 is a front perspective view of a cable management enclosure according to an embodiment.
Figure 38:
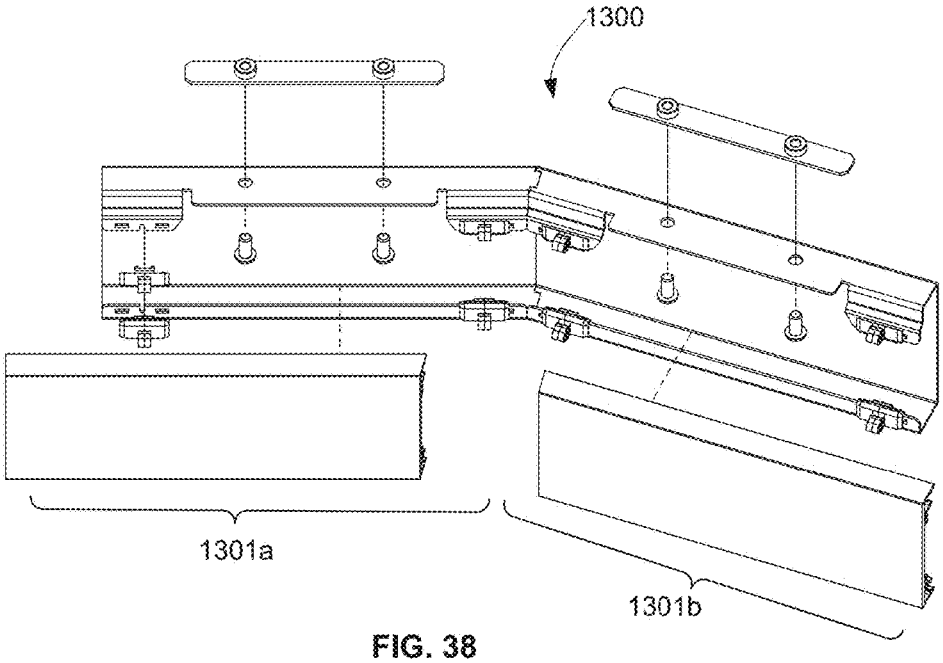
FIG. 38 is an exploded view of the cable management enclosure of FIG. 37.

FIG. 37 is a front perspective view of a cable management enclosure 1300 according to some embodiments. FIG. 38 is an exploded view of the cable management enclosure 1300 of FIG. 37. The cable management enclosure 1300 of FIGS. 37 and 38 includes first and second sections 1301*a* and 1301*b* attached in series that are angled with respect to one another. The structure of each section 1301*a* and 1301*b* is similar to the cable management enclosure 1103 of FIG. 31. The cable management enclosure 1203 in FIGS. 35 and 36 is similar, but with three sections rather than two.

Figure 39:
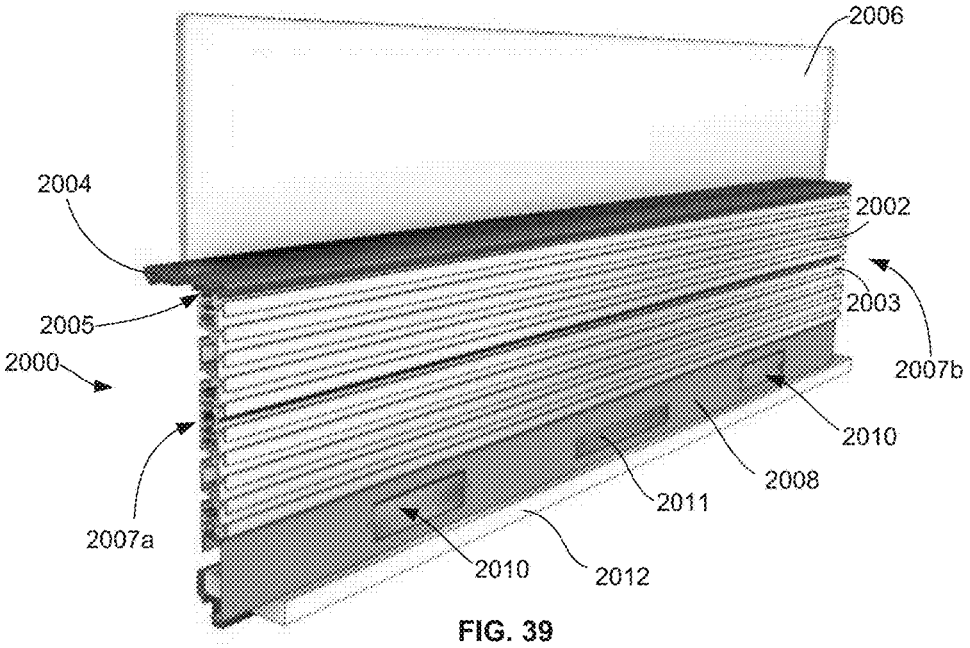
FIG. 39 is a perspective view of a slat wall assembly according to another embodiment.

FIG. 39 is a perspective view of a slat wall assembly 2000 according to another embodiment. The slat wall assembly 2000 includes upper and lower slat wall panels 2002 and 2004, which are stacked. The slat wall 2000 also includes an upper cladding or strip 2004 along its top edge 2005, which extends along the full length of the slat wall assembly 2000. The strip may be an extrusion, such as a plastic extrusion. Additional strips (not shown) may continue over the sides 2007*a* and 2007*b* of the slat wall and may connect with the upper strip 2004. A clear or semi-transparent panel 2006 (e.g. glass, Plexiglas™, plastic, etc.) is mounted on the strip 2004. The panel 2006 may be lit (e.g. edge-lit) and may be configured to provide information (e.g. by colors, patterns or other visual indications). A front cover 2008 is also shown. The cover 2008 includes openings 2010 and brush grommet 2011 that may be used for cable routing or ventilation, for example. The slat wall assembly 2000 is mounted on an upper console panel 2012 similar to panel 504 in FIG. 17.

In some embodiments, a slat wall assembly may include a first set of one or more front slat panels and second set of one or more rear slat panels. In other words, in some embodiments, the slat wall assembly may have a back-to-back slat wall configuration. Such a configuration may be used in combination with a console having back-to-back front and rear work surface panels, for example.

Figure 40:
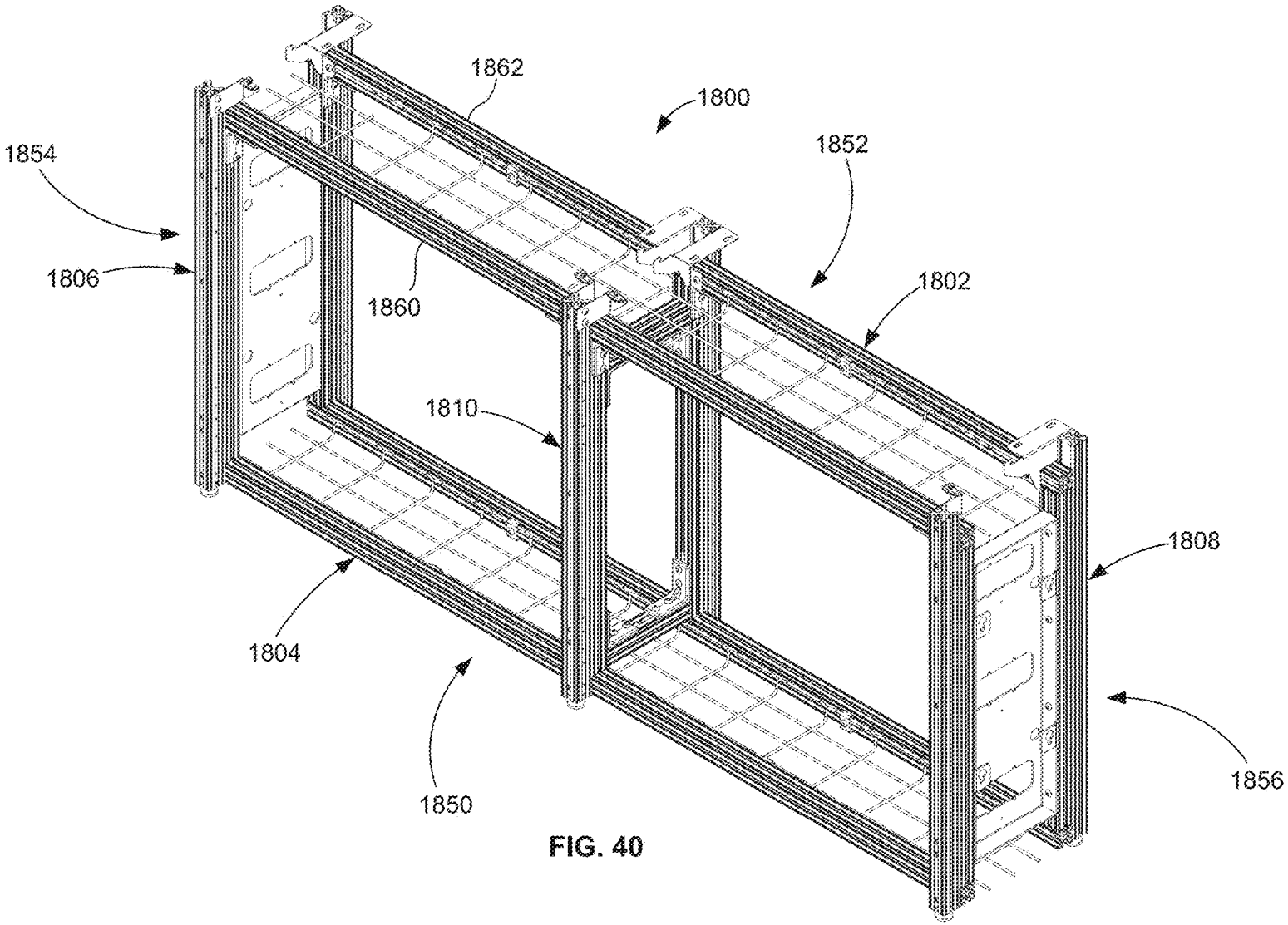
FIG. 40 is a perspective view of an example frame module for a console according to one embodiment.

FIG. 40 is a perspective view of an example frame module 1800 for a console according to one embodiment. The various slat wall and slat rail assemblies described herein may be mounted to the frame module 1800 in some embodiments.

The frame module 1800 forms a generally rectangular prism or box shape, including an upper top frame section 1802, a lower frame section 1804, and opposing first and second leg frames 1806 and 1808. In this embodiment, the frame module 1800 also includes an intermediate frame section 1810 (although other embodiments may omit the intermediate frame section). The upper frame section 1802 and the lower frame section 1804 extend between and interconnect the first and second leg frame frames 1806 and 1808.

FIG. 40 indicates a front 1850, back 1852, a first sides 1854 and a second side 1856 of the frame module 1800.

The intermediate frame section 1810 is positioned between the first and second leg frames 1806 and 1808 and provides additional support. The intermediate frame section 1810 in this example is in the form of a third leg section, similar to the first and second leg frames 1806 and 1808. The intermediate frame is selectively fixable to the upper frame section 1802 and/or the lower frame section 1804 such that the position of the intermediate frame is adjustable lengthwise along the upper and lower frame sections 1802 and 1804. In other words, the intermediate frame section 1810 is horizontally adjustable and may be secured at various positions along the upper and lower frame sections 1802 and 1804. For example, in this embodiment, the intermediate frame section 1810 can slide along the upper and lower sections 1802 and 1804 when not secured. Fastening hardware (e.g. screws, clamps, clips, bolts, etc.) may be used to secure the intermediate frame section 1810 to the upper frame section 1802 and/or the lower frame section 1804 in a desired position.

By allowing horizontal adjustment of the intermediate frame section, the load bearing ability of the frame module 1800 may be customized. For example, if particularly heavy equipment is to be used toward one side of a console including the frame module 1800, then the intermediate frame section 1810 may be moved toward that side to provide additional structural support. Additionally, the adjustability of the intermediate frame section 1810 may allow for customization of storage spaces and equipment arrangement in a console including the frame module 1800.

In some embodiments, the frame module 1800 may further include one or more additional intermediate frame sections (not shown). The additional intermediate frame section(s) may be fixed in various positions between the first and second leg frames 1806 and 1808. Each of the plurality of intermediate frame sections may be horizontally adjustable and selectively fixable in various positions.

In some embodiments, a console frame structure may include two or more frame modules that are interconnected. The two or more frame modules may comprise the frame module 1800 shown in FIG. 40, for example. Alternatively, the console frame structure may include a single frame module.

The upper frame section includes first and second upper beams 1860 and 1862. By way of example, the connectors 306*a* and 306*b* in FIG. 3 may connect to the first or second beam 1860 or 1862 to mount a slat wall assembly or a slat rail assembly.

Figure 41:
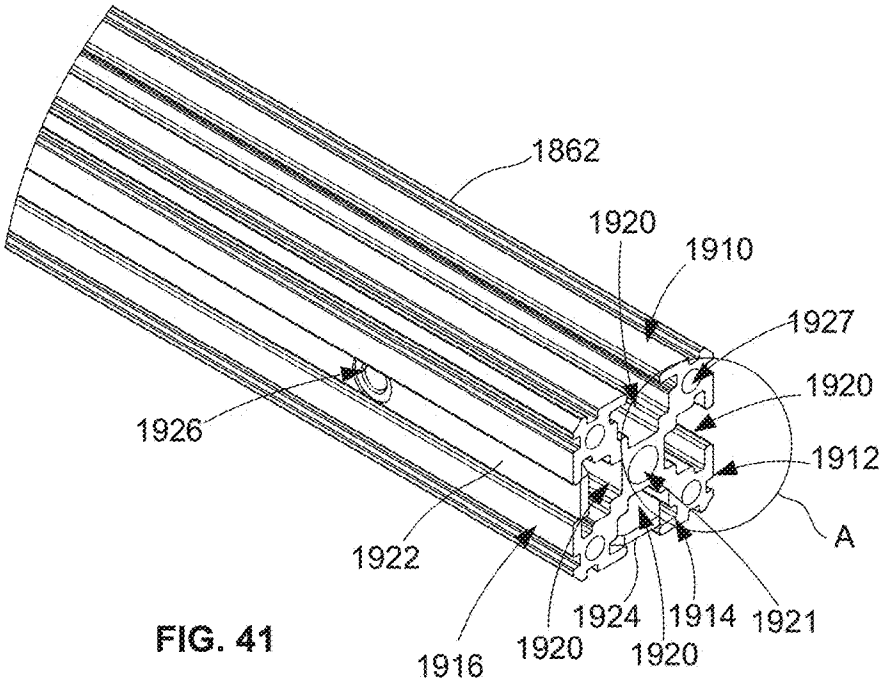
FIG. 41 is an enlarged partial view of the portion of an upper beam of the frame module of FIG. 40.

FIG. 41 is an enlarged partial view of the portion of the second upper beam 1862. The first upper beam 1860 has the same structure as the second upper beam 1862. As shown, the second upper beam 1862 has four elongate sides 1910, 1912, 1914 and 1916, each defining a respective port 1920 along the length thereof. The ports 1920 are in the form of elongate slots for attachment or mounting of various components and equipment. The ports 1920 have a profile shaped for receiving bolts, screws or other fastening hardware (as shown in more detail in FIG. 4).

Optional hole 1921 extends lengthwise along the center axis of the second upper beam 1862. Additional optional holes 1927 extend lengthwise through the second upper beam 1862. The holes 1921 and 1927 may also reduce the material required and weight of the extrusion while still providing sufficient structural stability and support.

Figure 42:
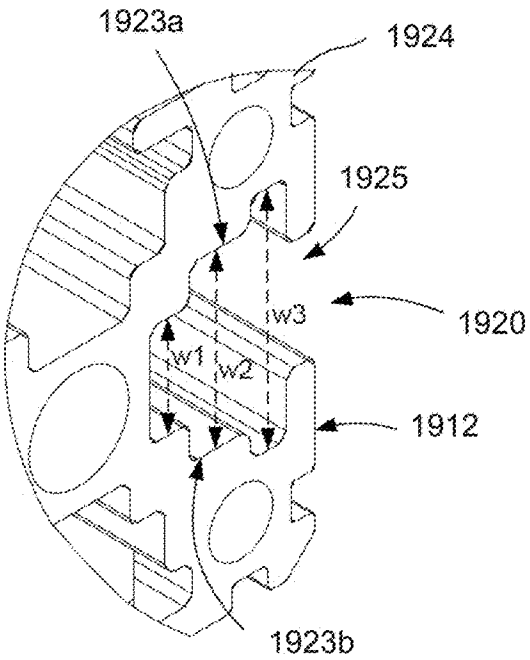
FIG. 42 is a further enlarged partial view of the portion of the second upper beam within the circle marked "A" in FIG. 41.

FIG. 42 is a further enlarged partial view of the portion of the second upper beam 1862 within the circle marked "A" in FIG. 41. The port 1920 in side 1912 of the second upper beam 1862 is visible. As shown, port 1920 defines an opening 1925 and stepped side walls 1923*a* and 1923*b* that provide multiple widths w1, w2 and w3 within the port 1920. The width w3 is wider than the opening 1925. The remaining ports 1920 shown in FIG. 3 have a similar structure. The profile of the ports 1920 may allow bolt heads, nuts, attachment strips or other hardware to be received and held within the ports 1920. The shape, structure and arrangement of the ports 1920 is shown by way of example and embodiments are not limited to this particular implementation.

The ports 1920 are used for attaching various components and/or equipment to the frame module 1800, as well as attaching the first and second upper beams 1860 and 1862 to the first and second leg frames 1806 and 1808 and the intermediate frame section 1810 in FIG. 40. Turning back to FIG. 41, example attachment strips 1922 and 1924 are shown within the ports 1920 of the sides 214 and 216. The attachment strip 1922 includes multiple self-clinching nuts 1926 for receiving fastening hardware (such as bolts). For example, bolts may attach connectors (such as the connectors 306*a* and 306*b* in FIG. 3) to the beam 1862 using attachment strip 1922 in the same or similar manner as described above. However, as also mentioned above, embodiments are not limited to the use of ports with attachment strips therein for attaching a slat wall assembly or slat rail assembly to a console frame.

Figure 44:
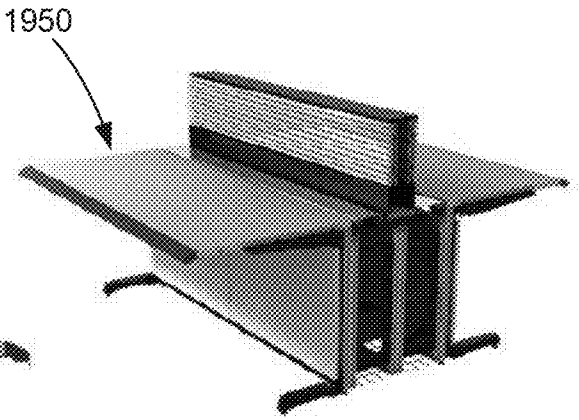
FIG. 44 is a perspective view of the console of FIG. 43.
Figure 43:
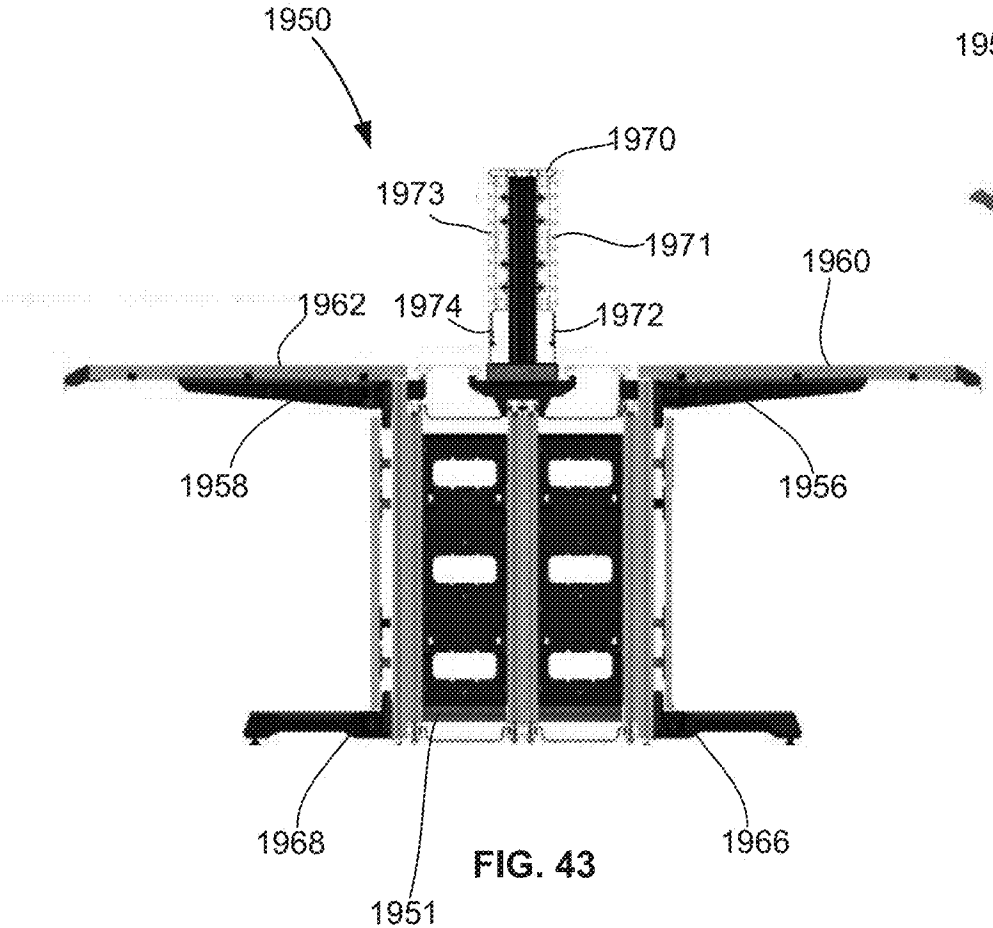
FIG. 43 is a side view of a console according to yet another embodiment having a "back-to-back" configuration.

FIG. 43 is a side view of a console 1950 according to yet another embodiment having a "back-to-back" configuration. The console 1950 includes a frame module 1951 similar to the frame module 400 in FIGS. 13 to 16. The console 1950 also includes one or more front support arms 1956 and one or more rear support arms 1958 attached to the frame module 1951. The front support arms 1956 support a first work surface panel 1960 mounted thereon, and the rear support arms 1958 support a second work surface panel 1962 mounted thereon. The second work surface panel 1962 and the rear support arms 1958 essentially mirror the first work surface panel 1960 and the front support arms 1956 in this example, although embodiments are not so limited. Mirrored front feet 1966 and back feet 1968 are also provided. A back-to-back slat wall assembly 1970 (having forward and rear facing slat walls) is mounted centrally on the frame module 1951. The slat wall assembly has a front facing slat wall 1971 and cover 1972 under the slat wall 1971. The slat wall assembly also has a rear facing slat wall 1973 and cover 1974 under the rear facing slat wall 1973. The front and rear facing covers 1972 and 1974 may include openings or a brush grommet providing passage for cables, air circulation etc. FIG. 44 is a perspective view of the console 1950 of FIG. 43.

Elements of the embodiments described above may be combined. It is to be understood that embodiments are not limited to the particular combinations of features shown in the Figures. For example, various modifications to the frame module 100 shown in FIG. 1 may be implemented in the various consoles and console frame structures shown and described. Similarly, the slat wall and slat rail features described herein may be combined with any of the frame modules, console frame structures or consoles, or may be omitted.

What has been described is merely illustrative of the application of the principles of the disclosure. Other arrangements and methods can be implemented by those skilled in the art without departing from the scope of the present disclosure.

The invention claimed is:

1. An equipment mounting assembly comprising:

at least one slat panel, each said at least one slat panel having a respective front face and a respective rear face, and comprising a respective plurality of horizontal slats on the front face;

at least one upright support member, each said at least one slat panel being mounted to the at least one upright support member at the rear face of the slat panel; and for each upright support member, a respective connector for mounting the upright support member to a structure, wherein each said connector comprises:

a respective collar portion having a periphery, the collar portion comprising a collar that defines a channel that extends at least partially about the periphery;

at least one plate extending downward from the collar portion for engaging a frame member of the structure;

the collar portion defining a generally vertical passage therein that receives the respective upright support member, the upright support member extending upward from the collar portion when received in the passage, wherein the at least one plate further engages and is securable to the upright support member.

2. The equipment mounting assembly of claim 1, wherein, for each said connector, the collar of the collar portion comprises:

a respective wall having an upper, outwardly extending lip; and another respective plate below the wall that extends outwardly beyond the wall, the other plate, the upper lip and the wall thereby forming a channel.

3. The equipment mounting assembly of claim 1, wherein the collar portion defines a second generally vertical passage therethrough.

4. The equipment mounting assembly of claim 1, wherein the plate of the collar portion defines one or more holes for receiving fastening hardware to secure the plate to a bottom face of a work surface panel.

5. The equipment mounting assembly of claim 1, wherein the connector further comprises at least one plate extending upward from the collar portion that engages and is secured to the upright support.

6. The equipment mounting assembly of claim 1, wherein the upright support comprises a post.

7. The equipment mounting assembly of claim 1, wherein the upright support defines at least one elongate port along a length of the upright support, the port being configured for receiving fastening hardware.

8. The equipment mounting assembly of claim 7, further comprising one or more attachment strips, each said attachment strip received in a respective one of the at least port and comprising one or more holes and, for each hole, a self-clinching nut aligned with the hole.

9. The equipment mounting assembly of claim 1, wherein each at least one slat panel comprises a respective slat wall panel.

10. The equipment mounting assembly of claim 9, wherein the at least one slat wall panel comprises two or more slat wall panels.

11. The equipment mounting assembly of claim 10, wherein the two or more slat wall panels are stacked vertically.

12. The equipment mounting assembly of claim 11, wherein the slats of the at least one slat panel are equally spaced.

13. The equipment mounting assembly of claim 9, wherein each slat panel defines one or more elongate ports along a length of the slat panel, the one or more ports being configured for receiving fastening hardware.

14. The equipment mounting assembly of claim 9, further comprising a housing enclosure, the at least one slat panel positioned at a front of the housing enclosure.

15. The equipment mounting assembly of claim 14, wherein the housing enclosure comprises a front cover, the front cover comprising at least one opening.

16. The equipment mounting assembly of claim 1, wherein the at least one slat panel comprises a single slat panel in the form of a slat rail.

17. The equipment mounting assembly of claim 16, wherein the slat rail has a top and a bottom, the slat rail defining an elongated upper port in the top thereof for receiving a mounting strip for a vertically aligned panel.

18. The equipment mounting assembly of claim 17, further comprising the panel, the panel being mounted to the connecting strip on the slat rail.

19. A connector for a slat panel assembly comprising an upright support member, the connector comprising:

a collar portion having a periphery and comprising a collar that defines a channel that extends at least partially about the periphery, the collar comprising a wall extending at least partially around a periphery of the collar portion, and having an upper, outwardly extending lip, and a plate below the wall that extends outwardly beyond the wall and is generally parallel to the upper lip, wherein the plate, the upper lip and the wall thereby form the channel; and at least one other plate extending downward from the collar portion, the collar portion defining a generally vertical passage therethrough to receive the upright support member, the upright support member extending upward from the collar portion when received in the passage, wherein the at least one other plate further engages and is securable to the upright support member.

* * * * *